US006745603B1

(12) United States Patent
Shaw

(10) Patent No.: US 6,745,603 B1
(45) Date of Patent: Jun. 8, 2004

(54) ELECTROMAGNETIC INTEGRATIVE DOOR LOCKING DEVICE AND METHOD OF INSTALLATION

(76) Inventor: Barry Shaw, 3306 N. Olcott, Chicago, IL (US) 60634

( * ) Notice: Subject to any disclaimer, the term of this patent is extended or adjusted under 35 U.S.C. 154(b) by 0 days.

(21) Appl. No.: 09/790,455

(22) Filed: Feb. 22, 2001

(51) Int. Cl.[7] ..... E05B 47/00
(52) U.S. Cl. ..... 70/278.1; 70/277; 70/283
(58) Field of Search ..... 29/602.1; 70/278.1, 70/283, 277

(56) References Cited

U.S. PATENT DOCUMENTS

| | | | | |
|---|---|---|---|---|
| 3,733,861 A | | 5/1973 | Lester | |
| 3,748,878 A | | 7/1973 | Balzano | |
| 3,899,906 A | | 8/1975 | Bradstock | |
| 4,126,341 A | | 11/1978 | Bradstock | |
| 4,211,443 A | * | 7/1980 | Butts et al. | 292/341.16 |
| 4,218,903 A | | 8/1980 | Eads | |
| 4,593,543 A | * | 6/1986 | Stefanek | 70/134 |
| 4,745,784 A | | 5/1988 | Gartner | |
| 4,831,851 A | | 5/1989 | Larson | |
| 4,848,118 A | | 7/1989 | Tesone | |
| 4,913,475 A | * | 4/1990 | Bushnell et al. | 292/144 |
| 4,916,927 A | | 4/1990 | O'Connell | |
| 4,917,425 A | | 4/1990 | Logas | |
| 5,074,602 A | | 12/1991 | Hwang | |
| 5,100,184 A | * | 3/1992 | Schmitt | 292/144 |
| 5,118,150 A | | 6/1992 | Jarrett | |
| 5,136,870 A | | 8/1992 | Gartner et al. | |
| 5,177,988 A | * | 1/1993 | Bushnell | 70/279.1 |
| 5,201,200 A | * | 4/1993 | Hauber | 70/107 |
| 5,469,727 A | | 11/1995 | Spahn et al. | |
| 5,542,274 A | | 8/1996 | Thordmark et al. | |
| 5,561,997 A | | 10/1996 | Milman | |
| 5,636,880 A | * | 6/1997 | Miller et al. | 292/144 |
| 6,422,614 B1 | * | 7/2002 | Kuntz et al. | 292/144 |

OTHER PUBLICATIONS 4730 series deadlatch brochure, Adams RiteSwing door hardware.
4418A series brochure, ADams R ight MaNUFACTURING Co. (installation kit).

* cited by examiner

*Primary Examiner*—Anthony Knight
*Assistant Examiner*—Michael J. Kyle
(74) *Attorney, Agent, or Firm*—Adrienne B. Naumann

(57) ABSTRACT

Described herein is an electromagnetic locking device which integrates mechanical lock components in a hollow metal door frame with electronic access components. The physical and mechanical modifications comprise a magnetic field generating device, an appropriately shaped metal housing and a cam retaining locking bar. The method for integrating a magnetic field generating device and cam retaining locking bar with previously installed mechanical lock components minimizes service costs and replacement of doorframes.

2 Claims, 12 Drawing Sheets

FIG. 1
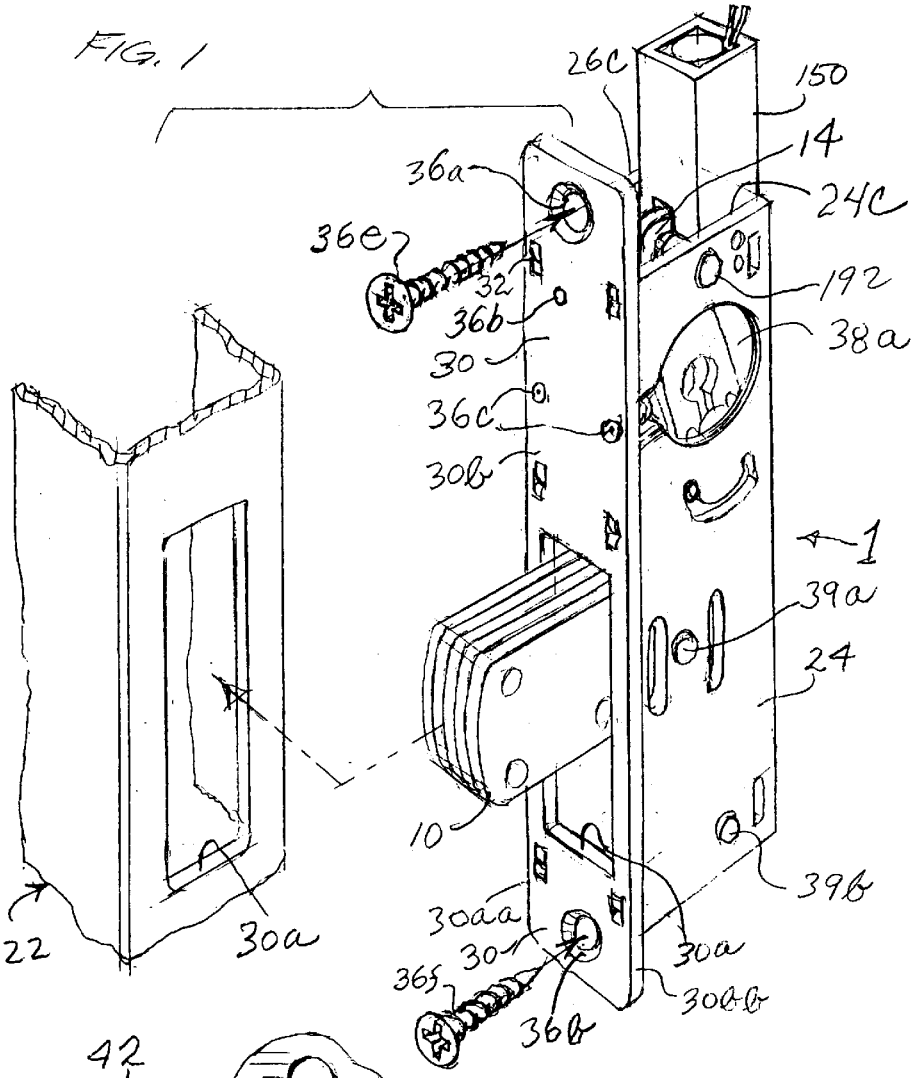
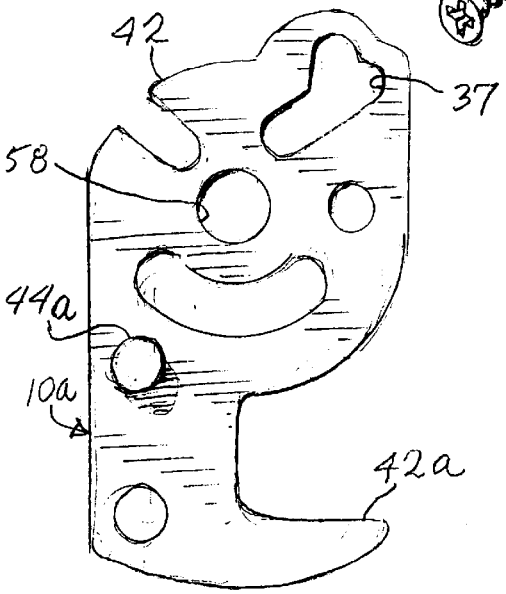
FIG. 2a PRIOR ART
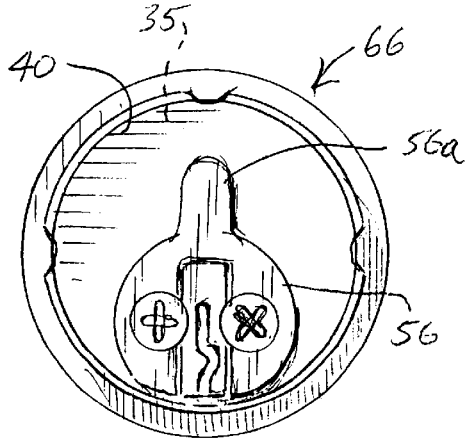
FIG. 2b PRIOR ART 430b
36e
36c
56a
38a
210a
86
10
36f
430a 123
150
1b
36c
38a
90aa
90bb
118a
118b
1c
36c
210
86
10

FIG. 6f PRIOR ART
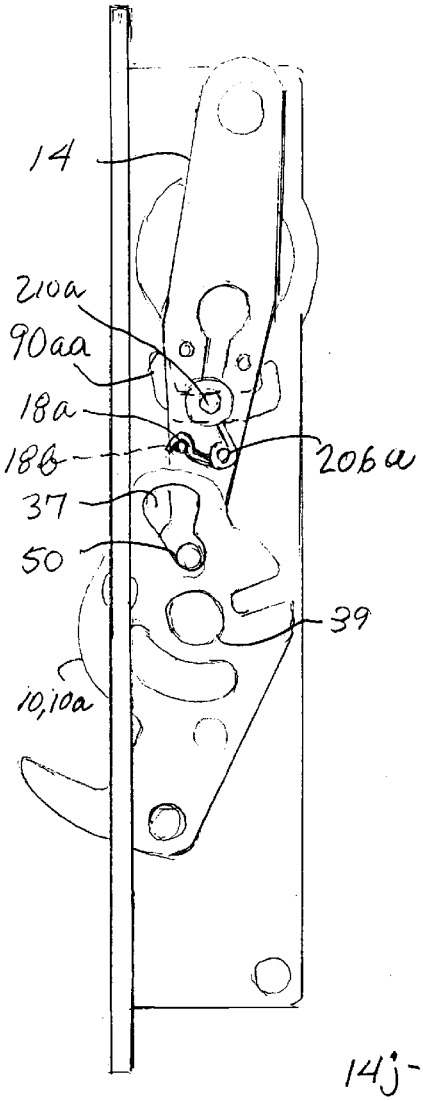
FIG. 6g PRIOR ART
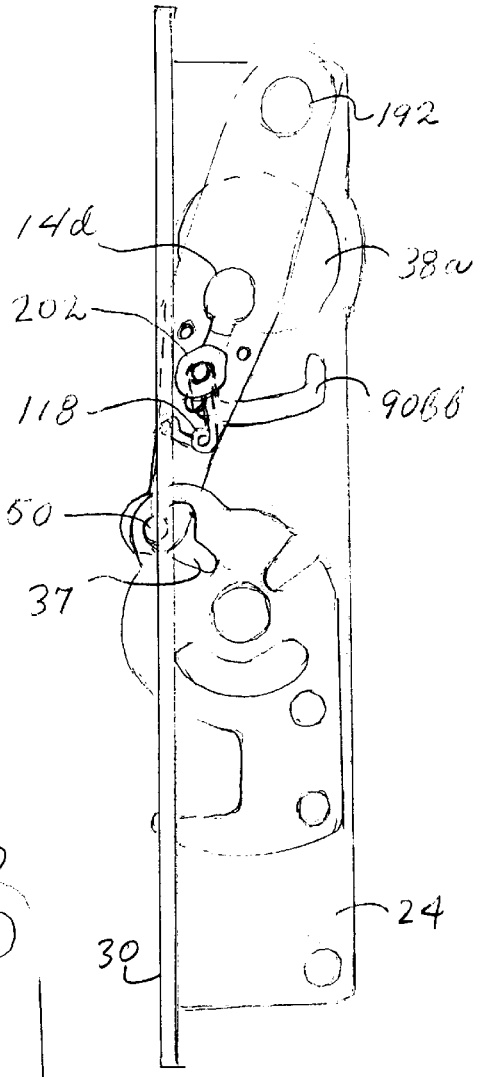
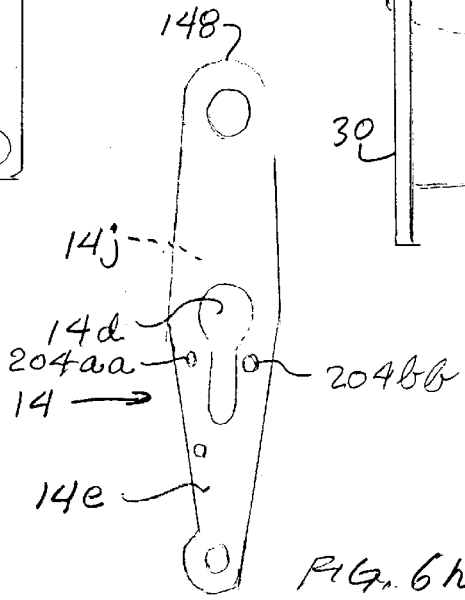
FIG. 6h PRIOR ART 142a
18
142b
150
151b
192
192a
151d
14
24
26

18

150
118b
118g
14f
14e
56
36c
90aa
90bb
10
30
24

ELECTROMAGNETIC INTEGRATIVE DOOR LOCKING DEVICE AND METHOD OF INSTALLATION

BACKGROUND OF THE INVENTION

My invention relates to electromagnetic lock components which can be universally integrated with mechanical lock components previously installed within a doorframe. In particular my invention relates to electromagnetic locking components and deadbolt, all of which are enclosed within a hollow doorframe casing.

My integrated lock is best suited to narrow stile doors, such as doors generally comprised of a glass core with a surrounding hollow metal frame. The lateral longitudinal plate comprises a longitudinal surface from which the bar or bolt extends through a rectangular opening. In addition to this lateral longitudinal plate, my invention comprises anterior and posterior plates. A longitudinal edge of each anterior or posterior plate is attached to a corresponding edge of the lateral longitudinal plate and forms a three-sided enclosure with two right angles.

In the preferred embodiment of my invention, the mechanical deadbolt operates from a fully extended position to a fully retracted position within the rectangular opening through an arc of 90 degrees. The operating mechanism comprises a rocking lever mounted perpendicular to the deadbolt. The rocking lever physically engages the deadbolt through pins and slot connections.

The cylindrical lock in my preferred embodiment is of the conventional type operable by a key. This lock cylinder carries a cylindrical extendable shaft which in turn comprises a rotating cam member. This cylindrical shaft is rotated either clockwise or counterclockwise by turning the key within it.

The inner end of the deadbolt is bifurcated, and the legs formed therefrom contain arcuate shaped apertures. The legs are pivotally attached to the lower end of a rocking lever by a pivot pin which extends though the lower portion of the rocking lever. The rocking lever is physically positioned above the deadbolt and is adjacent to the lock cylinder.

Two opposing roller cams are mounted on a sleeve, and the sleeve ends move in a limited manner within curved apertures within each anterior or posterior plate. Each of these apertures in each plate is arcuate and at its ends each has upwardly extending grooves. In operating the rocking lever, there is engagement of each opposing roller cam within each anterior and posterior plate and within the lever, by which each roller cam moves within the limits of a keyhole shaped aperture within the rocking lever.

My invention does not change the function, purpose or intent of the prior art mechanical locking device: to secure the door against parties who do not have a correct key on unauthorized occasions. Business owners confront certain days and/or hours in which it is difficult, impossible or very expensive for a locksmith to make a service call and rekey the locks.

Installation of my invention alleviates this problem by addition of the following to the existing mechanical deadbolt or hookbolt:

1) solenoid or other magnetic field generating device;
2) a solenoid cylindrical casing which connects the solenoid to a prior mechanical installed lock component;
3) a hollow stem inserted in the cavity of the solenoid cylindrical casing with a locking portion attached thereto; and 4) a small spring between the hollow stem and hollow cavity within the solenoid cylindrical casing, The access control portion of the electronic portion of my invention includes:

1) an exterior door or frame mounted reader (i.e, proximity, magnetic swipe, biometrics hand reader, bar code reader, Dallas touch chip reader, digital pushbutton keypad reader, etc);
2) a door controller device which contains a circuit board, including but limited to memory e-prompt components, relay battery and wire connectors;
3) a transformer power supply and the appropriate wire connecting components.

Such an access control system enables the business owner to, when combined with computer-based systems, create a report showing authorized employee access with the appropriate time and date. The door controller device identifies, via the reader, the previous entered information as to who can or cannot gain access. The authorized person must insert his key, rotate the extendable shaft or pivot pin, and gain access.

When the door control time has expired, (usually about 5 or six seconds) the power rapidly ceases, thus not allowing the key to turn within the exterior cylinder lock. To comply with relevant fire codes, the interior cylinder lock on the inside surface of the doorframe is not controlled by the cam retaining locking bar.

The process of installation of the electromagnetic component is another feature of my invention. My novel process of installation provides a significant economic advantage in large buildings such as, but no exclusively, commercial office space. In these buildings, many locks can be simultaneously upgraded with electronic security components without replacing the entire door. There also need be no new apertures cut into the hollow metal doorframe casing which require more expensive lock hardware.

Using my process, the operator removes the lateral, anterior and posterior plates and inserts a solenoid and associated components within the hollow metal doorframe casing.

The prior art discloses numerous mechanical locks cooperating with electrical components. However, these electrical components are not designed for installation after the mechanical locking component is installed within the doorframe. U.S. Pat. No. 5,561,997 (Milman) discloses a cylindrical barrel type lock wherein rotation of the barrel is prevented by one or more armatures. These armatures in turn are actuated by an electromagnet.

U.S. Pat No. 5,542,274 (Thordmark et al.) discloses a cylinder lock comprising a key operated cylinder plug. A latching element is located near the boundary surface between the lock cylinder and a plug. There is also an electrical blocking element which moves between a release position and a blocking position.

U.S. Pat. No. 3,733,861 (Lester) discloses an early electronic recognition door lock. There is a solenoid which is activated to withdraw an abutment member from the path of a laterally slidable door bolt mechanism. U.S. Pat. No. 5,469,727 (Spahn et al.) discloses an electronic lock cylinder comprising a housing with a cylindrical core.

Electronic control circuits are coupled inductively via coils for transmission of coding information. There is separate assembly of the mechanical components and of the electronic components of the lock cylinder.

Spahn's electronic lock cylinder differs in part from my pending invention in that there is no disclosure of a process which integrates the electronic and mechanical components after prior installation of the mechanical component within a door frame. U.S. Pat. No. 5,136,870 (Gartner et al.) discloses an electronic door lock. A digitally operated code input pad assembly enters a first code and a second code to open a second lock mechanism with the door spring bolt. These locks are adaptable for replacement of an ordinary deadbolt lock mechanism. However, Gartner's lock does not provide for subsequent installation within a doorframe of only the electronic lock component at a minimum cost and destruction of the doorframe.

Other early locks have even less technically in common with respect to upgrades with my present invention. U.S. Pat. No. 4,916,927 (O'Connell et al.) discloses a lock in which a solenoid can move an obstructing element entire into a recess.

The presence or absence of the solenoids's magnetic field prevents turning of the shaft within a key cylinder. However, O'Connell's device must be installed with all its components simultaneously into a doorframe.

U.S. Pat No. 4,831,851 (Larson) discloses a lock mechanism comprising a mechanical combination lock and an electronic lock. The mechanical combination lock serves as a fail-safe entry in case of failure of the electronic lock. However, this lock is specifically applicable to small safe deposit boxes.

U.S. Pat. No. 4,745,784 (Gartner) discloses an electronic dial combination lock. U.S. Pat No. 3,748,878 (Balzano et al.), discloses an electrically controlled manual unit for a door lock. This lock also comprises a cylinder which contains a solenoid. The solenoid is energized to engage a clutch for rotation of the knob and connecting cam. Balzon's system, however, does not comprise an electronic component which can be installed subsequent to the mechanical lock unit within a door frame.

SUMMARY OF THE INVENTION

My locking device comprises electromagnetic locking components combined with mechanical locking components. My locking device also integrates previously installed mechanical locks with override electronically controlled locking components. This second level of electronic security can comprise, for example, proximity access code readers which are currently used in large commercial buildings with numerous offices. Other applications of my invention include schools, industrial plants and other large commercial buildings, wherein authorized access by employees and students is mandatory.

The scope of my invention includes physical and mechanical modifications of a variety of existing electronic and mechanical locking systems. However, my preferred embodiment is that of electronic upgrades to the deadbolt key activated device described herein.

The addition of a solenoid or equivalent electromagnetic device with a hollow stem and attached cam-retaining locking bar to any pre-existing mechanical lock is common to all embodiments of my invention. With my invention, the assembling operator attaches a solenoid/cam retaining locking bar above the mechanical locking components previously installed within a hollow metal doorframe casing.

Accordingly, one purpose of my invention is to integrate mechanical lock components previously installed within hollow glass/metal doorframes with a variety of existing or future access controlled locking devices, particularly those of a proximity access code reader variety.

Another purpose of my invention is to lower the cost per door frame of upgrading existing mechanical locks with electronic security features, such as electric strikes and magneticlocks.

Another purpose of my invention is to provide small businesses with hollow glass/aluminum doors to economically obtain secure and affordable access control locking devices to these doors.

These and other aspects of my invention will become apparent in the following detailed description of the preferred embodiment and other embodiments of my invention.

BRIEF DESCRIPTION OF THE DRAWINGS

FIG. 1 illustrates a cutaway perspective view of the hollow metal doorframe casing and a partial anterior exterior view of my doorlock components.

FIG. 2*a* is a lateral view of typical prior art deadbolt.

FIG. 2*b* is a posterior view of a typical prior art cylinder lock with an attached rotating cam.

FIG. 6 illustrates prior art mechanical lock components with lateral longitudinal plate removed.

FIG. 6*a* illustrates an isolated closeup view of a rocking lever and attached rotating cam with integral protruding member.

FIG. 6*b* illustrates an isolated closeup lateral view of a prior art thumbturn component.

FIG. 6*c* is an isolated prior thumbturn and attached thumbturn plug in my invention.

FIG. 6*f* is a lateral isolated view of the interaction of prior art mechanical components in a locked position, and with the posterior plate removed.

FIG. 6*g* is a lateral isolated view of the interaction of prior art mechanical components in an unlocked retracted position, and with the posterior plate removed.

FIG. 6*h* is an isolated lateral longitudinal view of a prior art rocking lever.

DETAILED DESCRIPTION OF THE PREFERRED EMBODIMENT

Introduction

Figures 2C, 3A, 3B:
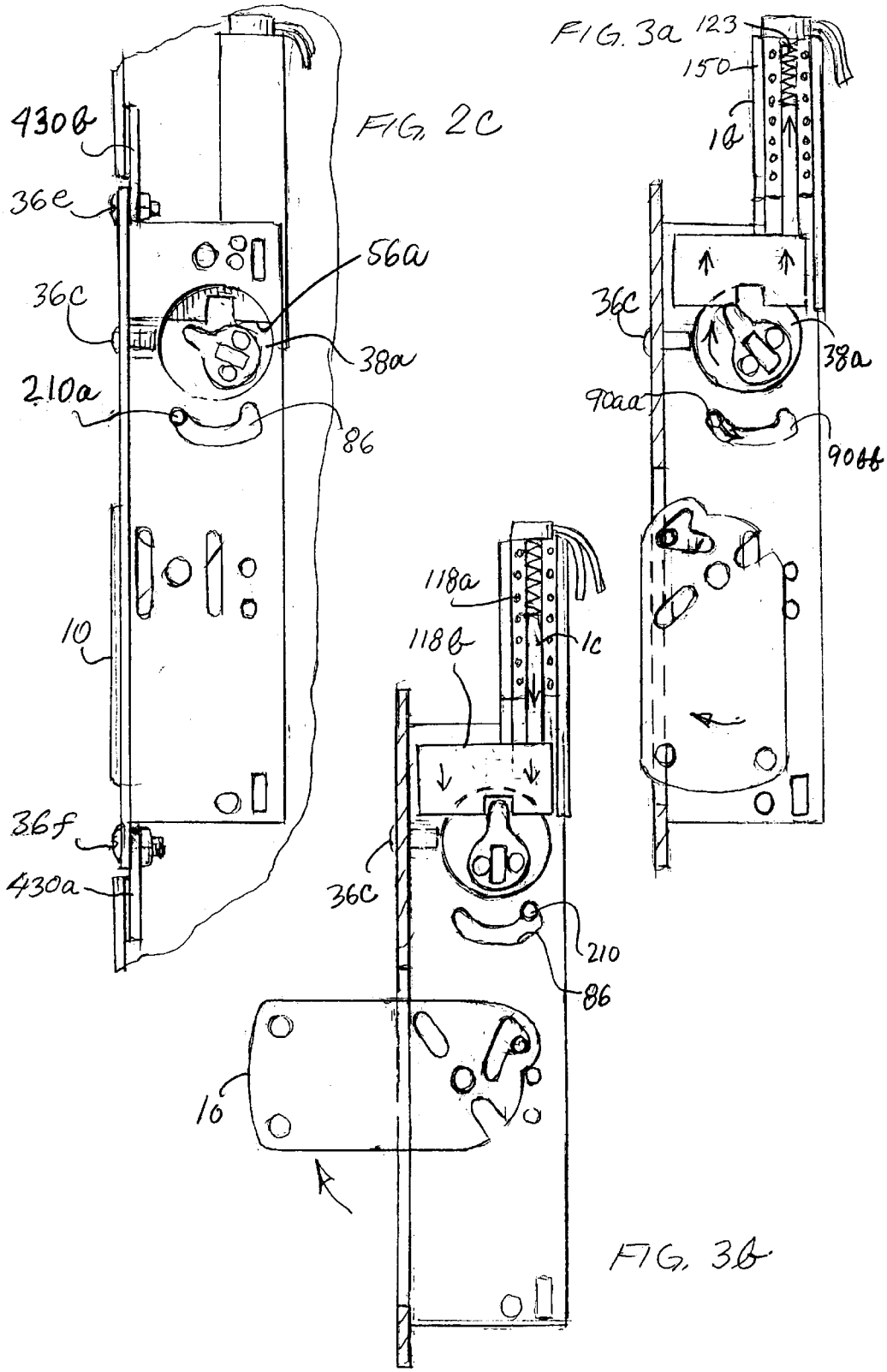
FIG. 2*c* is an anterior lateral view of the assembled lock components.
FIG. 3*a* is a lateral view of mechanical and electronic locking components in an open unlocked position, and with the posterior plate removed.
FIG. 3*b* is a lateral view of mechanical and electronic locking components in a locked position and with the posterior plate removed.

My electromagnetic integrated lock 1 comprises electromagnetic lock components with integrated prior art deadbolts 10 or hookbolts 10*a*. Each deadbolt 10 or hookbolt 10*a* was previously installed within a predetermined metal hollow doorframe casing 22. The great advantage of my integrated lock is enhanced security without undue destruction of the existing hollow metal doorframe casing 22 and previously installed mechanical lock components.

My integrative lock components fit within any hollow metal doorframe casing 22, but most preferably within a glass core/aluminum doorframe casing. Other doorframes with similar material, mechanical and other physical properties are also within the scope of my invention.

My invention also comprises the method for installing an electromagnetic field generating device into a glass core/aluminum doorframe casing 22 containing a previously installed mechanical deadbolt 10 or hookbolt 10*a*. Using this method, the operator attaches a solenoid 1*a* and cam retaining locking bar 118*b* with hollow stem 118*a* above a pre-existing rocking lever 14 and deadbolt 10 within doorframe casing 22.

My novel installation method and integrated lock system includes an access code proximity reader 302 and associated processor 313 in the preferred embodiment. Such prior art electronic components and their operative installation are well known to those in the electronic security/locksmithing industry.

Existing non-electronic mechanical lock components which are compatible with my invention include, but not exclusively:

a) non-electronic glass core/aluminum door type deadbolts 10 and hookbolts 10*a*, including but not exclusively those of Adams Rite® Manufacturing Co.
4040 S. Capitol Ave.
P.O. Box 1301
City of Industry, Calif. 91749
Phone: 562-699-0511
Models: MS 1850 series,
MS 1851, MS 1853

Trans Atlantic Co.
440 Fairmont Ave. Philadelphia, Pa. 19124 Phone: 215-629-0400;
888-523-9956
Model(Deadbolts): # DB 3231×31/32" BS,
DB 3236×1 and 1/8" BS
Model (Hookbolts): # HL3241×31/32 BS
HL3236×1 and 1/8" BS Ultra Hardware Products, LLC.
1777 Hylton Road
Pennsauken, N.J. 08110
Phone: 800-426-6379
Fax: 888-858-7210
Model #: 4465, 44646, 44650, 44648 (Deadbolts)
44655, 45660, 44656, 44658 (Hookbolts)

International Door Closer
1920 Air Lane Drive
Nashville, Tenn. 37210
Phone: 1-615-885-706; 1-800-225-6737
Model #: DT 1853, 31/32"
DH 1823-5
DH 1823-H, 1 and 1/8"
DT 1851
DT 1852
DT 1854 All with 1 and 1/2" backset,
DT 1855 with and without weatherstrip
DT 1853

Prime-Line
P.O. Box 9910
San Bernadino, Calif. 92427
Phone: 800-255-3505
J-4524, J-4567
J-4525, J-4568
J-4526, J-4567
J-4537, J-4568

Installation of my electromagnetic integrative components is economical, when using access control security technologies such as proximity reads, bar code reads and Dallas Touch Chip®. These technologies also include the ubiquitous swipe cards presently on the market, as well as any future developed electronic access features. Readers, push button keypad technologies or electronic timers are also satisfactory. However, the most preferred electronic access technology for my invention is a proximity access code reader 302, which is a device well known in the industry.

The above list of mechanical and electronic access lock assemblies is non-exclusive. Other prior art mechanical lock components, or those developed in the future, are also within the scope of my invention. The central features of the preferred embodiment of my invention include:

(i) an on/off magnetic field source, most preferably a solenoid 1*a* connected to a proximity access code reader 302, and (ii) a cam retaining locking bar 118*b* and attached hollow stem 118*a* functionally connected to (iii) a mechanical locking component such as a deadbolt 10 or hookbolt 10*a*.

American National Standards Institute and Builders Hardware Manufacturer's Association (ANSI/BHMA) specifications are met by my invention as well.

Previously Installed Non-electronic Mechanical Lock

A hollow metal doorframe casing 22 may be left handed or right handed. If a hollow metal doorframe casing 22 is installed in a right-handed orientation, the hinges will be on the right side of the doorframe casing 22 and the lock is on the left hand side (when the operated is facing the exterior hollow metal doorframe 22 surface). Similarly, a hollow metal doorframe casing 22 with a left handed orientation has hinges on the left side of the doorframe casing 22; the lock is on the right side edge of the doorframe casing 22, when the operator is facing the exterior surface of that dooframe casing 22.

The preferred door for my invention are narrow stile doors, such doors generally being comprised of a glass core with a surrounding hollow metal doorframe casing 22. The preferred metal is aluminum for hollow metal doorframe casing 22. Also in the preferred embodiment is a hollow metal doorframe casing 22 with hardware preparation according to ANSI standards.

Figure 13A:
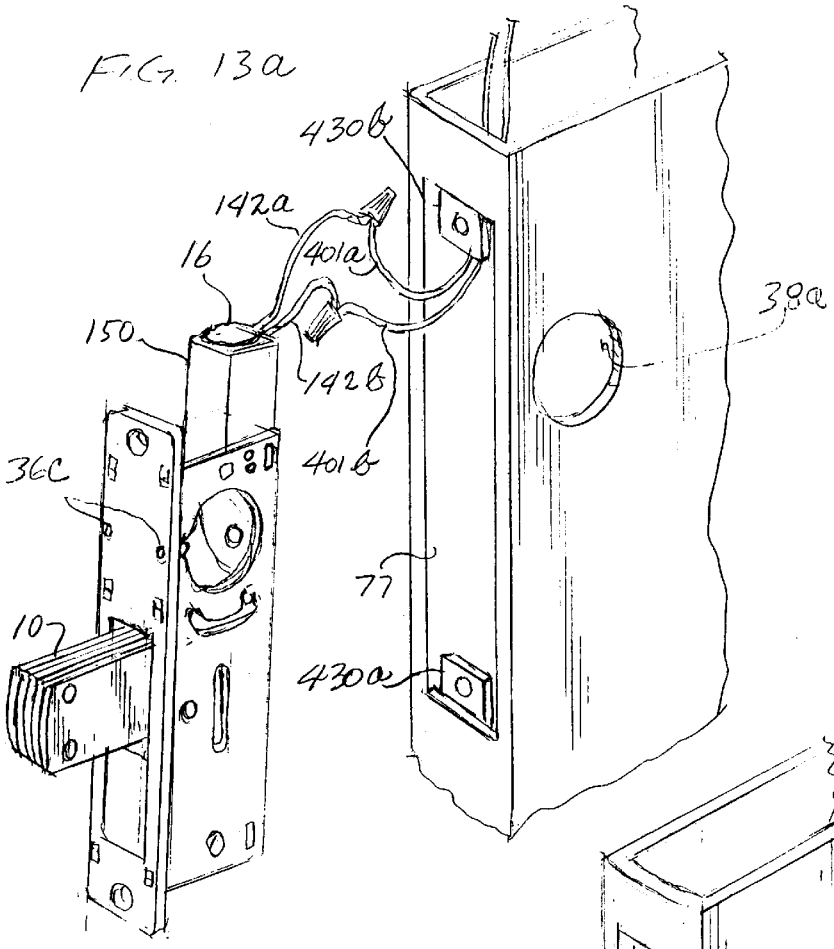
FIGS. 13*a* and 13*b* illustrates how the plate assembly containing the integrated lock components is reinserted into the hollow metal doorframe casing.
Figure 13B:
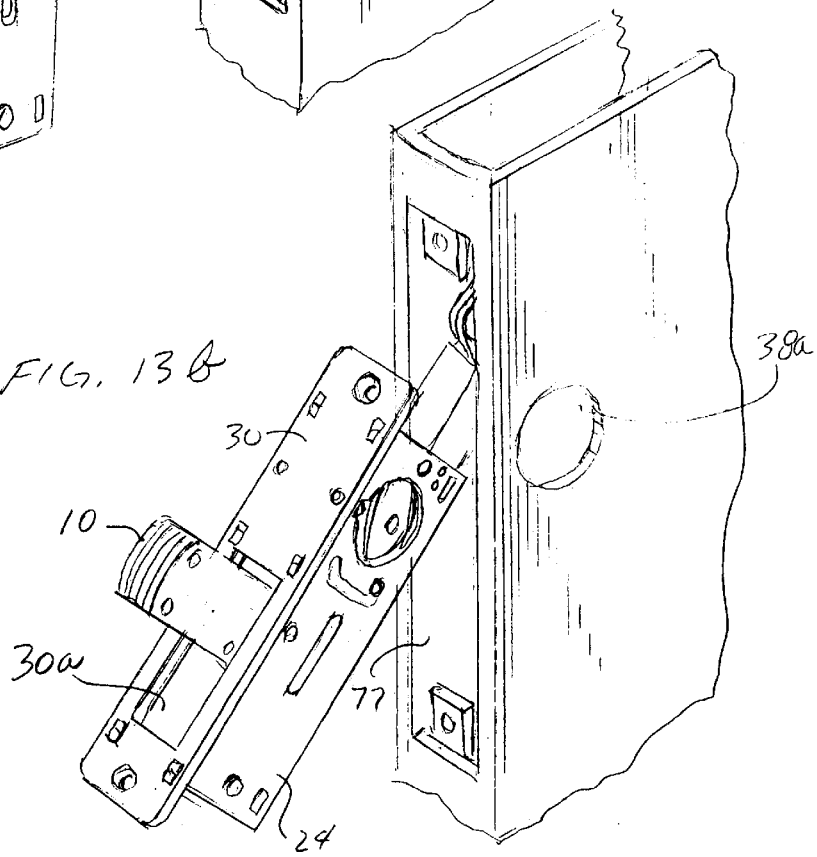

As seen in FIGS. 13*a* and 13*b*, the preferred hollow metal doorframe casing 22 comprises welded-in lock mounting tabs 430. Mounting tabs 430 require no post installation modifications to fit an actual lock with a mounting pattern conforming to ANSI standards. In a doorframe casing 22 without these integrally welded tabs, separately purchased individual tabs are attached to hollow metal doorframe casing 22.

The hollow metal doorframe casing 22 manufacturer for my preferred embodiment is:

International Aluminum

767 Monterey Park

Monterey Park, Calif. 91757

Website: www.intlalum.com

Door Model No. Series: 250, 400, 550

FIG. 1 is a cutaway perspective view of hollow metal doorframe casing 22. Within hollow metal doorframe casing 22 are anterior plate 24 and posterior plate 26 (not seen), and lateral longitudinal plate 30. Lateral longitudinal plate 30 has two longitudinal edge 30*aa*,30*bb*, each of which is attached to either anterior plate 24 or posterior plate 26 at an approximate 90 degree angle. In the preferred embodiment, a trim plate or face plate covers set screws 30*c* and gives lateral longitudinal plate 30 a more pleasing appearance.

Referring again to FIG. 1, anterior plate 24 comprises aperture access for mechanical lock components as well as the electronic components of my integrated invention 1. Posterior plate 26 (not seen) contains thumbturn 43 in my fully assembled invention. Thumbturn 43 is positioned on the office interior door surface, and it allows egress according to relevant fire and safety ordinances. Please see FIGS. 6*b*, 6*c*.

As seen in FIGS. 1 and 2*c*, set screws 36*c* support cylinder lock 66 and thumbturn 43 within large circular apertures 38*a*,38*b* (not seen in this view) respectively. Shorter mounting screw 36*a* and longer lower mounting screw 36*b* attach lateral longitudinal plate 30 to hollow metal doorframe casing 22.

Referring again to FIG. 1, longitudinal rectangular opening 30*a* lies congruently within lateral longitudinal plate 30 and hollow metal doorframe casing 22. Each plate 24, 26 is attached to lateral longitudinal plate 30 with pressure fitted (pinned) metal stubs 32 in a manner well known in the industry. Solid pins 39*a*,39*b* connect plates 24,26 to each other, while pin 39*a* also acts as a sleeve for rotation of deadbolt 10 or hookbolt 10*a*. Lateral longitudinal plate 30 has a longitudinal vertically oriented exterior surface 30*b*. Deadbolt 10 respectively extends through longitudinal rectangular opening 30*a* when deadbolt 10 is in an extended position.

The deadbolt 10 of my invention comprises a modified version of the mechanical locking assembly disclosed in U.S. Pat. No. 2,853,839 (C. W. Eads). FIG. 2*a* illustrates the preferred prior art deadbolt 10 comprising first and second legs 42, 44 respectively. Hookbolt 10*a* is another prototype which is similar to my preferred deadbolt 10 embodiment. The only difference between hookbolt 10*a* and deadbolt 10 is the curved configuration of hookbolt 10*a* which engages the opposite wall.

Again referring to FIG. 2*a*, deadbolt 10 or hookbolt 10*a* each comprise upper arcuate slot 37 and round bolt aperture 58. Upper arcuate slot 37 houses lever pivot pin 50.

Round bolt aperture 58 contains bolt support pin 39*a* and sleeve 39*b* (not seen in this view). In the preferred embodiment rivet 44*a* holds five steel plates together, thus forming either deadbolt 10 or hookbolt 10*a*.

Figure 6D:
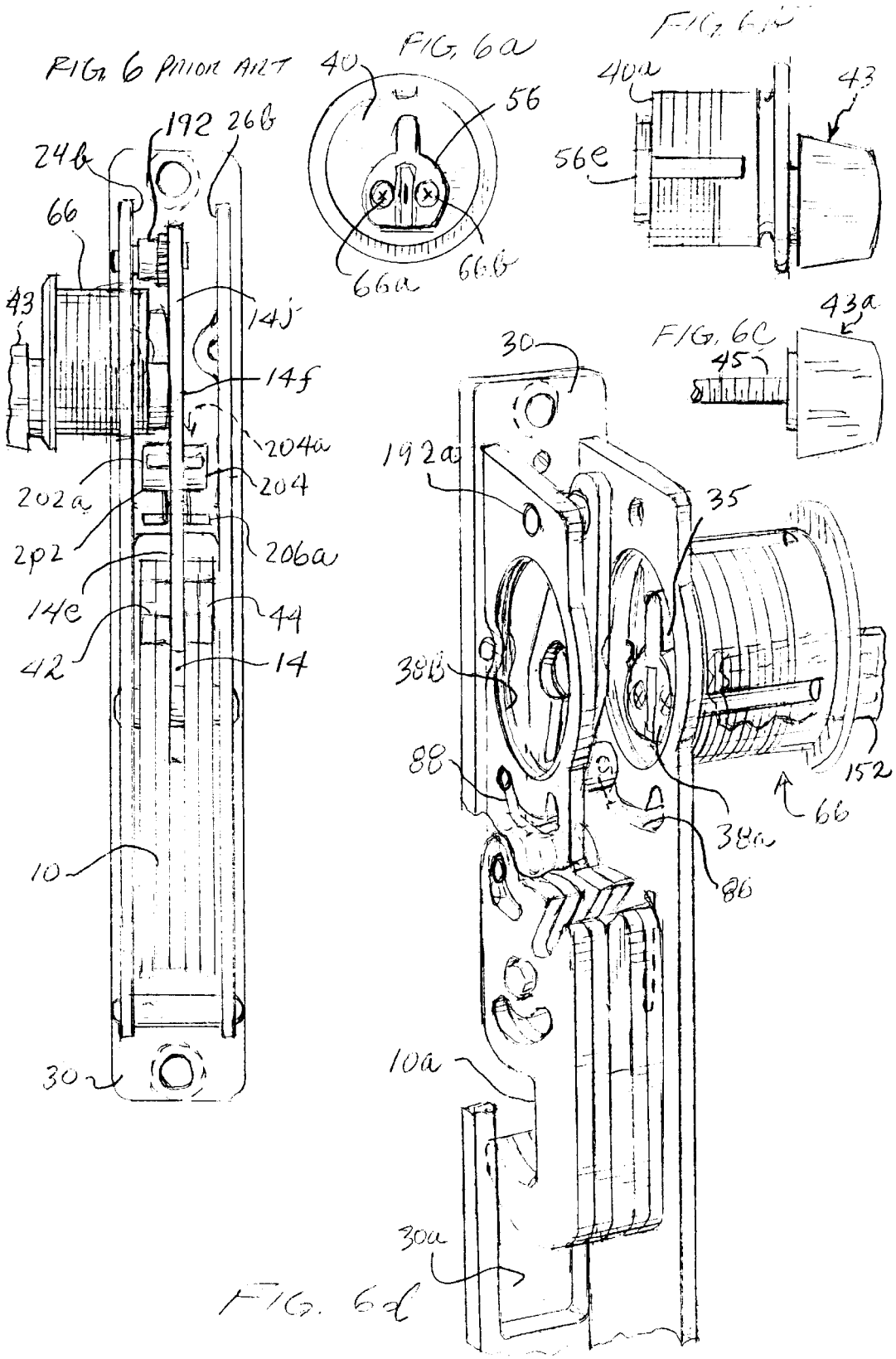
FIG. 6*d* illustrates the partially assembled mechanical prior art components.

Referring now to FIGS. 1 and 3*a*, anterior plate 24 comprises exterior threaded large circular aperture 38*a*. FIG. 6*d* illustrates posterior plate 26 which comprises interior large threaded circular aperture 38*b*(through which threaded thumbturn 43 inserts. Interior and exterior threaded circular large apertures 38*a*,38*b* respectively are each approximately one and three-quarters (1 and ¾ inch) in diameter.

Exterior large circular aperture 38*a* is the structure into which threaded cylinder lock 66 inserts within anterior plate 24. FIG. 2*b* is an isolated posterior view of cylinder lock 66. Posterior plate 26 comprises interior large circular aperture 38*b* into which thumbturn 43 inserts in a manner similar to that of lock cylinder 38, infra.

Referring to FIG. 6*d*, within cylinder lock 66 lies extendable shaft 35, and attached to its posterior end 40 is rotating cam member 56. Rotating cam member 56 is attached to lock cylinder 66 With two small screws 66*a*, 66*b*.

Posterior end 40 of extendable shaft 35 is 'journaled' into exterior large circular aperture 38*a*, and is supported therein by set screws 36*c*. Rotating cam member 56 rotates upon extendable shaft 35 with application of manual force to turn authorized key 152. Please see FIG. 6. Extendable shaft 35 does not turn until a properly fitted key 152 inserts within cylinder lock 66. As seen in FIG. 2*b*, rotating cam 56 comprises an integral protruding member 56*a*.

When key 152 is removed, protruding member 56*a* is positioned vertically upright at 12:00. At this moment, deadbolt 10 is in a locked or unlocked position, thus blocking extendable shaft 35 until key 152 is reinserted into cylinder lock 66. Lock cylinder 66 is of the conventional type which operates by key 152 in my preferred embodiment. Any standard one and 5⁄32 inch diameter mortise key cylinder lock 66 with a special Adams-Rite® MS rotating cam 56 is acceptable in the preferred embodiment.

As seen in FIGS. 6, 6*f* and 6*g*, thumbturn 43 is structurally similar to cylinder lock 66 in that it comprises a plug 45 attached to a permanently fixed second rotating cam 56*e* at posterior end 40*a*. However, no key is necessary to rotate second rotating cam 56*e* and initiate retraction of deadbolt 10, so that egress to an office exterior is universal: integral thumbturn handle 45*a* and attached plug 45 always turns rotating cam 5*e* when manual rotational force is applied. Attached second rotating cam 56*e* also holds thumbturn plug 45 firmly within thumbturn 43. Small screws 66*aa*, 66*bb* (not seen) attach second rotating cam 56*a* to plug 45.

Referring now to FIGS. 6, 6*f* and 6*g*, rocking lever 14 is positioned between first and second legs 42,44 respectively by lever pivot pin 50 within upper arcuate slot 37. Lever pivot pin 50 extends through lever 14 and completely penetrates deadbolt 10. As seen in FIG. 6*h*, rocking lever 14 comprises bulbular slot 14*d*, into which a first opposing roller cam 202 and a second opposing roller cam 204 lodge (not seen in this view). Referring to FIG. 6, first opposing roller cam 202 abuts first longitudinal lever surface 14*e* while second opposing roller cam 204 abuts second longitudinal lever surface 14*f*.

In addition, each first and second opposing roller cam 202, 204 respectively also abuts first extending pin 202*a* and second extending pin 204*a* (not seen in FIG. 6) respectively. Third extending pin 206*a* is located below first and second roller opposing cams 202,204; third extending pin 206*a* pierces lever 14 through each first and second longitudinal surface 14*e*, 14*f*. Third extending pin 206*a* also comprises first spring 18*a* and second spring 18*b*. Please see FIG. 6*g*.

First and second springs 18*a*,18*b* respectively each engage approximately one-half of the circumference of extending pin 206*a* and opposing roller cams 202, 204 respectively. First opposing roller cam 202 and second opposing roller cam 204 rotate around sleeve 210 and are mounted thereon. Sleeve ends 210*a*, 210*b* of sleeve 210 extend to and enter first and second curved apertures 86,88 respectively within anterior and posterior plates 24,26 respectively.

First small spring 18*a* and second small spring 18*b* wind around the circumferences of opposing roller cams 202, 204 and extension pin 206 respectively, on either longitudinal surface 14*e*,14*f*. First small spring 18*a* and second small spring 18*b* each generate an upward force: this occurs when small springs 18*a*,18*b* extend after rotating cam 56*a* presses down upon first opposing roller cam 202 or second opposing roller cam 204. This upward force tends to maintain first opposing roller cam 202 and second opposing cam 204 in the same position, unless manual force from a turning key 152 is applied in the opposite direction.

Referring again to FIG. 6, rocking lever 14 is mounted vertically between anterior plate 24 and posterior plate 26, and rocking lever 14 also physically abuts rotating cam 56. Referring again to FIG. 6*g*, in the preferred embodiment rocking lever 14 engages deadbolt 10 with lever pivot pin 50 within upper arcuate slot 37.

Upper arcuate slot 37 within deadbolt 10 accommodates the relative movement between physically contacting rocking lever 14 and deadbolt 10. Small adjacent apertures 202*aa* and 202*bb* accommodate extensions pins 202*a* and 204*a* respectively, as seen in FIG. 6*h*. Rocking lever 14 also comprises bulbular slot 14*d*, through which opposing roller cam members 202,204 move when authorized key 152 is inserted into extendable shaft 35. Large sleeve 192 penetrates first longitudinal surface 14*e* and second longitudinal surface 14*f*, as seen in FIG. 6.

Figure 8:
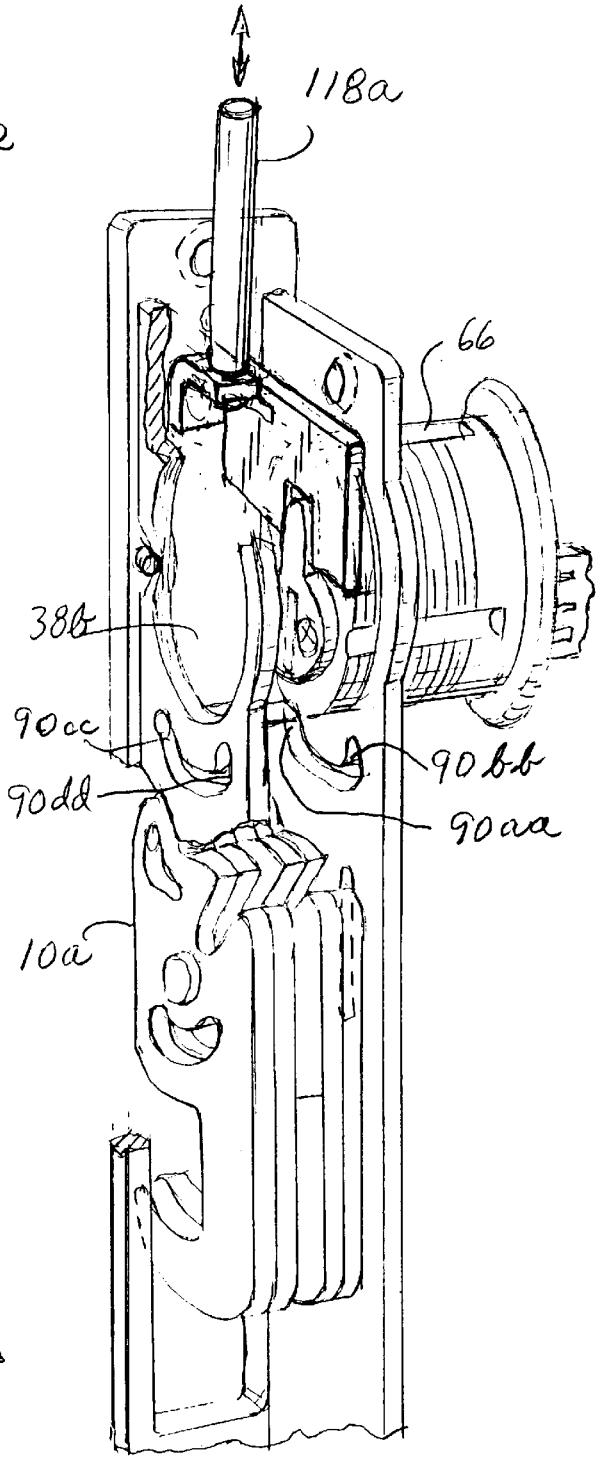
FIG. 8 illustrates a partial perspective view of the integrated locking components, and with posterior plate removed and lateral longitudinal plate partially cut away.

FIGS. 2*c*, 3*a* and 3*b* illustrates sleeve end 210*a* within first curved aperture 86 of anterior plate 24. Sleeve end 210*b* is similarly situated within second curved aperture 88 of posterior plate 26 (not seen in these views). Sleeve ends 210*a*, 210*b* each move within first curved aperture 86 and second curved aperture 88 respectively. First curved aperture 86, comprises first upwardly extending short grooves 90*aa*,90*bb*, while second curved aperture 86 comprises second upwardly extending short grooves 90*cc*,90*dd*. Please see FIG. 8.

The mechanical components of my invention operate as follows: Extending shaft 35 rotates as force is applied through an authorized key 152. Rotating movement of rotating cam 56*a* causes protruding member 56*a* to rotate downwardly.

While rotating downwardly, protruding member 56*a* directly pushes upon first opposing roller came 202 or second opposing roller cam 204 (depending upon whether these predetermined lock components are mounted in a left handed or right handed orientation). This direct force results in rotating cam 56 pushing against opposing roller cams 202 or 204, and thereby stretching small springs 18*a*, 18*b*. This direct force upon first opposing roller cam 202 and second opposing roller cam 204 also simultaneously pushes both opposing roller cams 202, 204 downwardly through bulbular slot 14*d*.

First and second opposing roller cams 202,204 respectively move downwardly through bulbular slot 14*d* as long as rotating cam's 56 force exceeds that of stretched first and second small springs 18*a*,18*b*. Sleeve ends 210*a*, 210*b* move through curved apertures 86,88 respectively.

Stretched small spring 18*a*,18*b* now push sleeve ends 210*a*,210*b* respectively upwardly into upwardly extending short grooves 90*aa*,90*bb*, and 990*cc*, 90*dd* respectively. At the same time, lever pivot pin 50 travels downwardly within upper arcuate slot 37, causing deadbolt 10 to rotate around bolt pivot pin 39 and retract deadbolt 10 to an open unlocked position.

When rotating cam 56 is rotated, sleeve ends 210*a*, 210*b* move through curved apertures 86 or 88 respectively. This movement occurs when sleeve ends 210*a*, 210*b* are pushed upwardly by first small spring 18*a* and a second small spring 18*b*. Movement to a retracted position by deadbolt 10 and lever 14 ceases when sleeve ends 210*a*,210*b* respectively finally lodge within upwardly extending short grooves 90*bb*, and 90*dd* respectively. Please see FIG. 6*g*.

Conversely, during a transition from a retracted position to the usual locked sleeve ends 210*a*,210*b* move in the opposite direction within first and second curved apertures 86,88 respectively. When returning to a locked position, each sleeve end 210*a*,210*b* moves through curved apertures 86,88 respectively until lodged within upwardly extending first and second grooves 90*aa*, 90*cc* respectively. The position of rocking lever 14 and deadbolt 10 is mechanically held in place within grooves 90*cc* and grooves 90*bb*.

As seen in FIG. 6*g*, deadbolt 10 is in a retracted unlocked position. To lock, key 152 now twists in the opposite direction or until rotating cam 56 is restored to its original vertical position. At the same time the tension of first and second small springs 18*a*, 18*b* forces rocking lever 14 and deadbolt 10 to a default lock position again.

When key 152 rotates and is then removed from cylinder lock 66, rotating cam 56 rotates to its original vertical position. At this point, rotating cam 56 no longer exerts force on first and second opposing roller cams 202 or 204.

Integrative electronic components of my invention FIG. 1 illustrates an exterior view of my electromagnetic integrated locking components within lateral longitudinal plate 30, anterior plate 24 and posterior plate 26. In the preferred embodiment crucial physical measurements are as follows:

(i) the distance between interior surfaces of 24*b*, 26*b* of anterior plate and posterior plate 26 respectively is slightly more than approximately ⅝ inch;

(ii) the distance between interior anterior plate surface 24*b* and longitudinal lever surface 14*e* is approximately ⅜ inch.

Figure 4A:
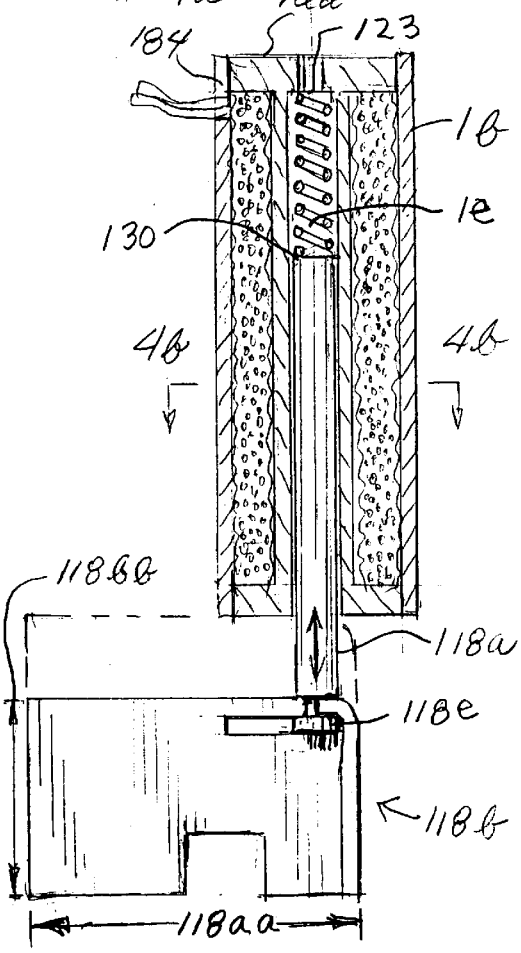
FIG. 4*a* is an isolated view of a solenoid within a cylindrical solenoid casing and attached to a cam retaining locking bar.
Figure 4B:
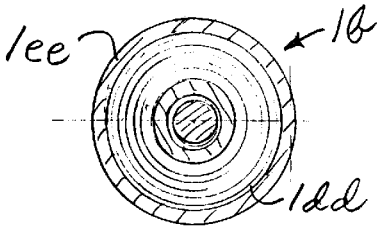
FIG. 4*b* is a top plan view of a cylindrical solenoid casing.
Figure 4C:
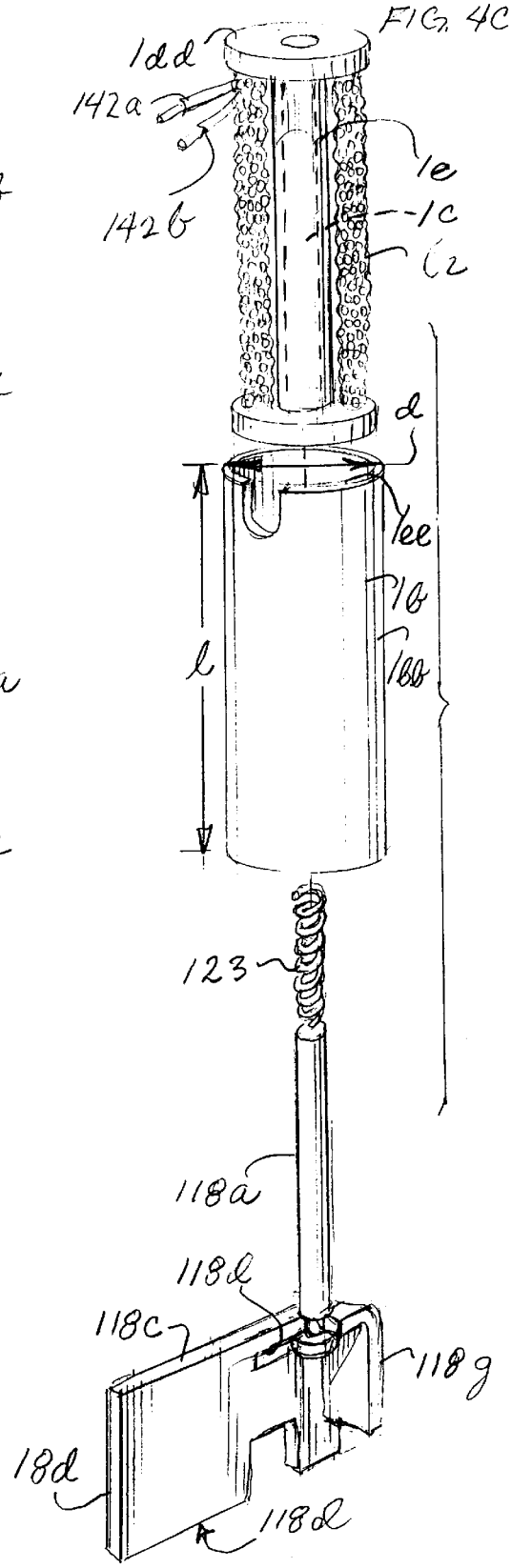
FIG. 4*c* is a disassembled view of a solenoid, solenoid cylindrical casing, solenoid housing and cam retaining locking bar with attached hollow stem.

(iii) the length 1 and diameter d of solenoid casing 1*b* are approximately 1 and ¾ inch, and ½ inch respectively;

(iv) the length of posterior plate 26 or anterior plate 24 is approximately six inches;

(v) the length of lateral longitudinal plate 30 is approximately seven inches;

(vi) the length of hollow stem 118*a* is approximately 1 and ¼ inch;

(vii) the width and length of cam retaining locking bar 118*b* are approximately 1 and ¼ inch and ¾ inch respectively;

(viii) the diameter of hollow stem 118*a* is approximately ⅜ inch;

(ix) the length of protruding member 56*a* is approximately ¼ inch;

(x) metal solenoid housing 150 is approximately 2 and ¾ inch in height, slightly less than ⅝ inch in width and depth, and its walls are approximately ⅛ inch in thickness;

In the preferred embodiment, the device which generates a magnetic field is solenoid 1*a*. However, other electromagnetic field generating devices are also within the scope of my invention 1. As seen in FIGS. 4*a* and 4*c*, in the preferred embodiment solenoid 1*a* comprises a cylindrically wound wire 130 forming a cylindrical cavity 1*c*. Cylindrical cavity 1*c* is approximately 1 and ¾ inches in length 1 and approximately ½ inch in diameter d.

Cylindrically wound wire 130 is approximately 81 feet in length, and is wound contiguously to form the entire length of solenoid 1*a*. The cross-sectional diameter of cylindrically wound wire 130 is approximately 0.015 inch in the preferred embodiment. Solenoid 1*a* is preferably comprised of copper wire in all its embodiments.

Cylindrical solenoid casing 1*b* is a cylindrical metal structure with a circular top metal surface 1*dd*.

Top metal surface 1*dd* also comprises the upper end of hollow cylindrical spool 1*e* upon which solenoid 1*a* is wound in the preferred embodiment. Top metal surface 1*dd* is attached at all points to upper circular edge 1*ee* of cylindrical solenoid casing 1*b*. Cylindrical solenoid casing 1*b* completely covers solenoid 1*a* on all surfaces, except for continuous solenoid pinhole 184. Solenoid cavity 1*c* lies within a hollow cylindrical spool 1*e*, as best seen in FIG. 4*c*.

Figure 5:
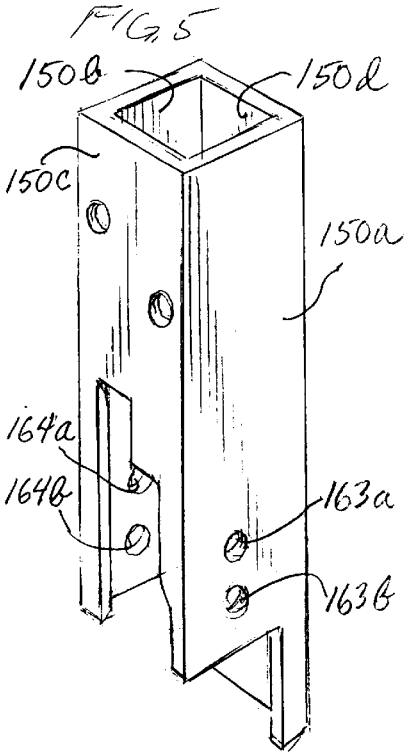
FIG. 5 comprises an isolated partial perspective view of a solenoid housing with screw apertures.
Figure 5E:
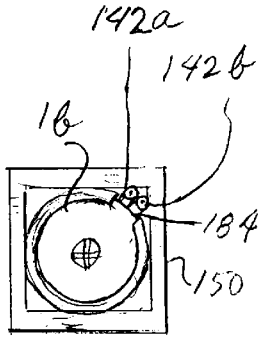
FIG. 5*e* is an upper plan view of a solenoid housing containing cylindrical casing 1*b*.

Referring now to FIGS. 4*a* and 5*e*, cylindrical solenoid casing 1*b* comprises continuous pinhole aperture 184. Continuous pinhole aperture 184 is formed in part between cylindrical solenoid casing side 1*bb* and circular top metal surface 1*dd*. First solenoid end wire 142*a* and second solenoid end wire 142*b*, which are integral with solenoid cylindrically wound wire 130, emerge from continuous pinhole aperture 184. First solenoid end wire 142*a* comprises the beginning segment of solenoid wire 130. Second solenoid end wire segment 142*b* electrically connects to a voltage source (not seen) and closes the circuit in a manner well known in this industry, infra.

In the preferred embodiment solenoid 1*a* comes preassembled upon hollow cylindrical spool 1*e* within cylindrical solenoid casing 1*b*. A preassembled solenoid 1*a* within a cylindrical casing 1*b*, and wound upon hollow cylindrical spool 1*e* for the preferred embodiment is available from:

TRW Space and Electronic Group
5200 Springfield Street
Beaver Creek, Ohio
Model Number 29.0250-16VAC
Phone: 937-253-1609, and is distributed through Adams Rite, Inc. In all embodiments, stainless steel is the preferred material for cylindrical solenoid casing 1*b*.

Referring now to FIGS. 1 and 5, cylindrical solenoid casing 1*b* containing solenoid 1*a*, lies within a metal solenoid housing 150. Metal solenoid housing 150 protects cylindrical solenoid casing 1*b* containing solenoid 1*a*, as well as the cylindrical cavity 1*c* into which hollow stem 118*a* inserts. Please see infra. Metal solenoid housing 150 fits between first and second interior opposing surfaces 24*b*, 26*b* respectively of anterior plate 24 and posterior plate 26 respectively.

Metal solenoid housing 150 comprises a hollow approximately rectangular polyhedron consisting of two first opposing parallel sides 150*a*,150*b* and two second opposing parallel sides 150*c*,150*d* (generically 150). Metal solenoid housing 150 attaches to anterior plate 24 by two small rivets 163*a*, 163*b*, and to posterior plate 26 by two small rivets 164*a*,164*b* (not seen in this view). Please see FIG. 5. There is no base or ceiling to metal solenoid housing 150.

Figure 16:
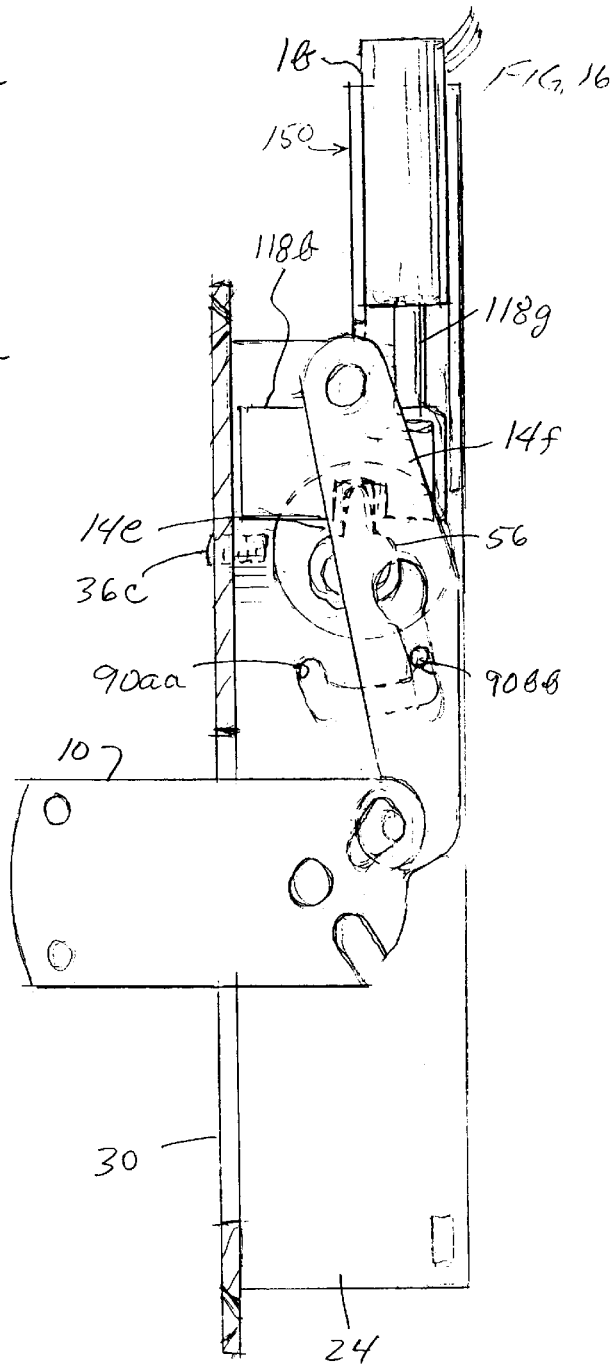
FIG. 16 is the lateral interior view of the lock assembly with the anterior plate removed, and in an entirely locked position.

Opposing parallel side 150*c* of metal solenoid housing 150 lies parallel to longitudinal lateral plate 30, and side 150*c* is shorter than opposing parallel side 150*d*. The preferred metal solenoid housing 150 is made from aluminum to avoid rust problems from drainage. As seen in FIG. 16 metal solenoid housing 150 does not interfere with round threaded circular apertures 38*a*,38*b*. Approximately ⅔ of metal solenoid housing 150 protrudes above first upper edge 24*c* of anterior plate 24 and second upper edge 26*c* of posterior plate 2. Please see FIG. 1.

Solenoid metal housing 150 can be made of tubing from:

J.G. Braun Co.
81145 River Drive Morton Grove, Ill. 60053
Phone: 1-800-323-4072

To prepare a metal solenoid housing 150 in the preferred embodiment, the operator uses a Dremel® wheel to section aluminum square tubing. This aluminum square tubing is approximately ⅝ inch in diameter and two feet in length, and is made of metal alloy number 6063-T52. Metal solenoid housing 150 can be easily massed produced by an appropriate tool shop in this manner. In addition, aluminum does not retain heat from solenoid electrical resistance, and this feature results in less damage to surrounding electronic components.

Figure 5A:
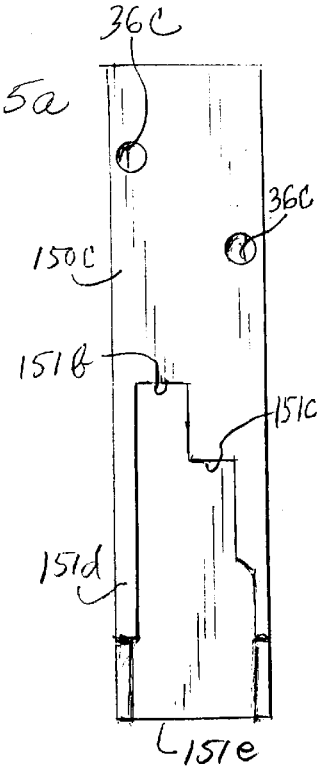
FIG. 5*a* is an isolated anterior view of a solenoid housing in a left handed orientation.
Figure 5B:
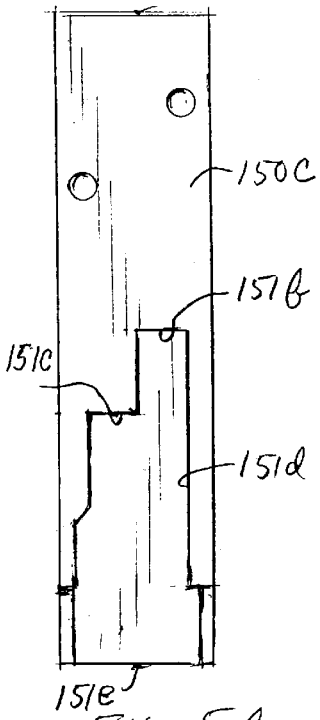
FIG. 5*b* is an isolated anterior view of a solenoid housing in a right-handed orientation.
Figure 5C:
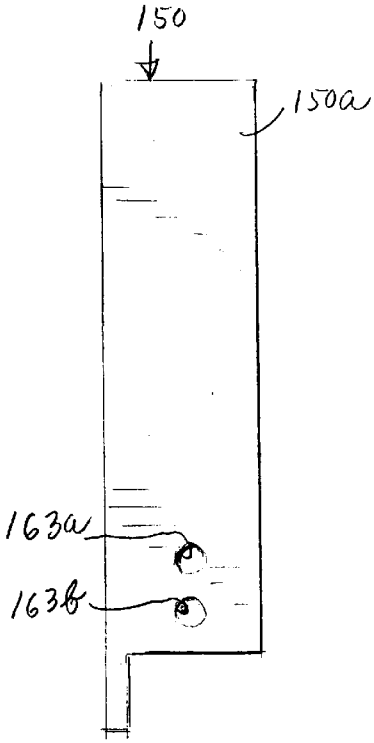
FIG. 5*c* is a lateral isolated view of a solenoid housing in a left-handed orientation.
Figure 5D:
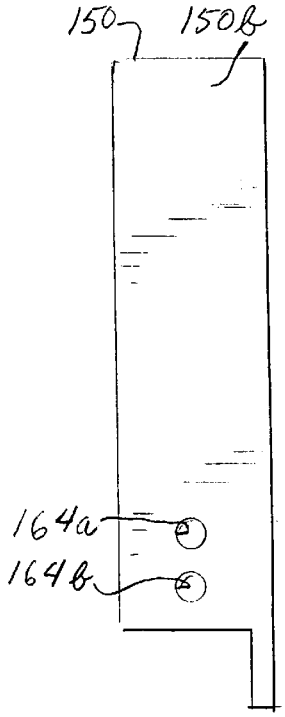
FIG. 5*d* is an isolated lateral view of a solenoid housing in a right-handed orientation.

Metal solenoid housing 150 appears in isolated closeup lateral view in FIG. 5*a*.

Solenoid housing lower edge 151 is shaped so protruding member 56*a* can rotate freely, and cam retaining locking bar 118*a* can easily disengage from rotating cam 56, infra. FIG. 5*a* illustrates first lower edge segment 151*d* of lower solenoid housing edge 151. With first lower edge segment 151*d* as a backstop, key 152 cannot force cam retaining locking bar 118*b* laterally, see infra. Also because of this physical backstop, movement of cam retaining locking bar 118*b* remains vertical.

FIG. 5*a* also illustrates second lower edge segment 151*b* of lower solenoid housing edge 151. Edge segment 151*b* is pre-cut to accommodate upper edge 14*g* of rocking lever 14, as well as large sleeve 192 and large pin 192*a*. This precut feature becomes especially important when metal solenoid housing 150 is pushed downwardly to its final position during the installation process.

Referring now to FIGS. 4*a* and 4*c*, third spring 123 lodges within hollow stem 118*a*, when hollow stem 118*a* is attached to cam retaining locking bar 118*b*. Solenoid cavity 1*c* within cylindrical solenoid casing 1*b* comprises a sufficient diameter for hollow stem 118*a* to move vertically upward within solenoid cavity 1*c*.

For the preferred embodiment, hollow stem 118*a* is available as a component from the catalogue model of:

TRW Space and Electronic Group
5200 Springfield Street
Beaver Creek, Ohio
Model Number 29.0250-16VAC
Phone: 937-253-1609, and is distributed through Adams Rite, Inc. Hollow stem 118*a* is fabricated from stainless steel in this preferred assembly. For other embodiments, hollow stem 118*a* is made from stainless steel pins.

In the preferred embodiment, attached to hollow stem 118*a* is cam retaining locking bar 118*b*. Cam retaining locking bar 118*b* comprises a length 118*aa*, a width 118*bb*, and a thickness 118*c*. Cam retaining locking bar 118*b* also comprises a small army 118*g* and a small ovoid slot 118*d* which grips hollow stem 118*a*. Notch 118*c* grips protruding member 56*a* in a default locked position, as described infra. Hollow stem comprises knob 118*e* which fits within arm 118*g* and ovoid slot 118*d*.

The measurements of cam retaining locking bar 118*b* in the preferred embodiment are approximately as follows: ⅝ inch in width, 1 and ¼ inch in length, and 1/16 inch in thickness. As seen in FIG. 5, cam retaining locking bar 118*b* abuts rocking lever 14 and is parallel to longitudinal surfaces 14*e*,14*f* of rocking lever 14.

Hollow stem 118*a* is approximately 3/16 inch in diameter and approximately 1 and ⅜ inches in length. As seen in FIGS. 4*a* and 4*c*, hollow stem 118*a* comprises knob 118*e*.

Knob 118*a* fits at approximately a right angle to and within small ovoid slot 118*d* in the preferred embodiment. However, other attachment devices of hollow stem 118*a* and cam retaining locking bar 118*b* are also within the scope of my invention.

Tension from third spring 123 against cylindrical solenoid casing 1*b* tends to return hollow stem 118*a* and cam retaining locking bar 118*b* to a lower position. Compression of third spring 123 against cylindrical casing surface 1*dd* also prevents inadvertent permanent magnetization of hollow stem 118*a*. Hollow stem 118*a*'s downward vertical movement is limited by the rectangular notch of cam retaining locking bar 118*b* around protruding member 56*a*. Please see FIG. 16.

When attached to cam retaining locking bar 118*b*, hollow stem 118*a* elevates linearly and parallel to solenoid cylindrical casing 1*b* within cylindrical cavity 1*c* when a magnetic field exists. A subsequent magnetic force field of solenoid 1*a* can initiate another access cycle by raising hollow stem 118*a* into cylindrical solenoid cavity 1*c* until the voltage is again discontinued.

Cam retaining locking bar 118*b* comprises an alloy mix to soften the steel component, so that cam retaining locking bar 118*b* can be die cast to the correct shape. In the preferred embodiment, cam retaining locking bar 118*b* is best obtained from:

Precision Hardware, Inc.
P.O. Box 74040
Romulus, Mich. 48174-0040
Phone: 734-326-7500

This cam retaining locking bar 118*b* is preferably the clip from model # 1639-10 of the electric strike 1639-10 series. In other embodiments, cam retaining locking bar 118*b* is best made from a thin steel sheet of appropriate thickness with chrome plating. In all embodiments, the alloy comprising cam retaining locking bar 118*b* is at least approximately 10% zinc and 50% steel. This particular alloy is also popularly known as pressed steel, or cold rolled steel, in the locksmithing industry.

Figure 7:
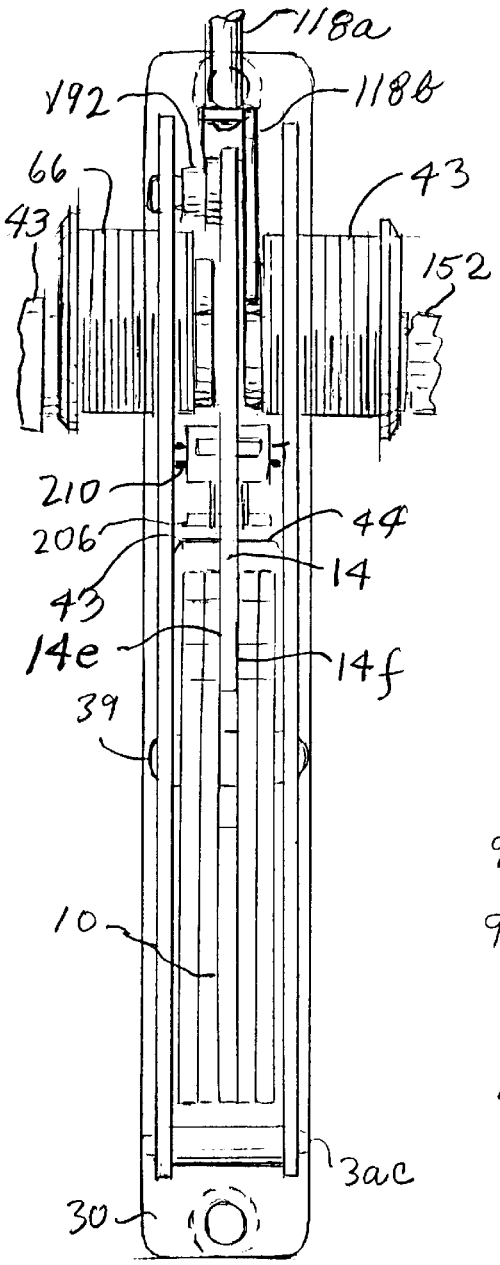
FIG. 7 illustrates a lateral posterior view of locking components, including a key and a thumbturn.

FIG. 7 illustrates my integrated lock components when posterior plate 26, metal solenoid housing 150 and cylindrical solenoid casing 1*b* are removed. Rocking lever 14 is adjacent to cam retaining locking bar 118*b*. FIG. 16 illustrates hollow stem 118*a* containing third spring 123 in default locked position. Hollow stem 118*a* containing third spring 123 lies partially within solenoid housing 150 and solenoid casing 1*b*.

Cylindrical solenoid casing 1*b* stands within metal solenoid housing 150. Referring again to FIGS. 3*a* and 3*b*, my integrated invention operates as follows in the preferred embodiment and best mode:

When solenoid 1*a* generates a magnetic force field, cam retaining locking bar 118*b* moves vertically upward until attached hollow stem 118*a* is further within solenoid cavity 1*c*. When power is added to solenoid 1*a* to generate a magnetic field, hollow stem 118*a* with attached cam retaining locking bar 118*b* elevates approximately ⅜ inch.

As seen in FIGS. 2*c* and 3*b*, cam retaining locking bar 118*b* disengages rotating cam 56. In this upper position, cam retaining locking bar 118*b* no longer restricts rotating cam 56 from rotating downwardly. As a result, rotating cam member 56 is now unhindered and rotates away from its blocking position of extendable shaft 35. Force from rotating key 152 causes protruding member 56*a* to abut and exert force upon first opposing roller cam 202 and second opposing roller cam 204 respectively.

When force is exerted by rotating cam 56 upon opposing roller cams 202,204, lever pivot pin 50 slides downwardly within slot 37. At the same time, sleeve ends 210*a*,210*b* move within curved apertures 86,88, and deadbolt pin 58 within slot 38 retracts deadbolt 10 to an open unlocked position, as described supra.

As illustrated in FIG. 3*a*, when voltage to solenoid 1*a* is discontinued, there is no magnetic field to pull cam retaining locking bar 118*b* vertically upward.

Cam retaining locking bar 118*b* falls vertically downward to again grasp protruding member 56*a*. Protruding member 56*a* physically blocks authorized key 152 from turning rotating shaft 35. First and second opposing roller cams 202, or 204 (depending upon whether this is a right handed or left handed assembly) now cannot initiate the mechanical events which result in retraction of deadbolt 10.

Tension of third spring 123 also contributes force, to return to the lower gripping position of cam retaining locking bar 118*b* and attached hollow stem 118*a* when there is no magnetic field. Again referring to FIG. 3(*b*), the electronic and mechanical components are in the default locked position when there is no magnetic field. Cam retaining locking bar 118*b* grips protruding member 56*a* rigidly so that rotating cam 56 prevents force upon opposing roller cams 202, 204.

As a result, there is no force upon first and second opposing roller cams 202, 204 to initiate deadbolt 10 retraction. Consequently, electronically controlled cam retaining locking bar 118*b* overrides key 152 access, when there is no magnetic field to elevate cam retaining locking bar 118*b* to a non-gripping position.

In the preferred embodiment, my invention uses proximity access codes for identification of authorized access and subsequent generation of voltage across solenoid 1*a*.

The process, known as radio frequency identification (RFID), is a method of reading an electronic key card 301 without physical contact between card 301 and reading device 302. The user holds electronic key card 301 to a reading device 302, and within the reading device's detection range, similarly to that of a television remote control device.

Figure 9:
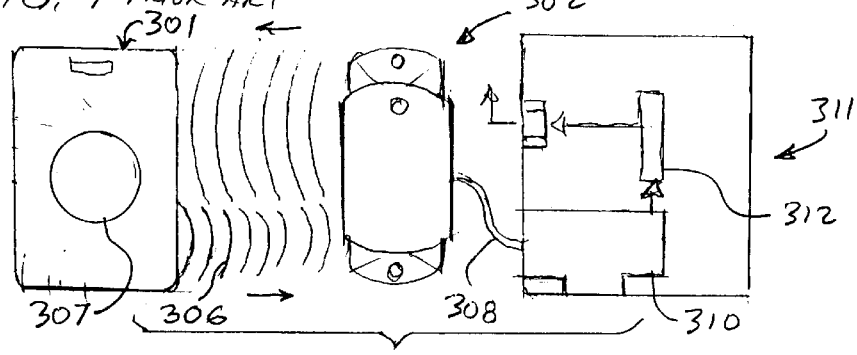
FIG. 9 PRIOR ART
FIG. 9 is a schematic representation of a proximity access code reader and processor.

Referring now to FIG. 9, immediately thereafter a continuous 125 kHz (kiloHertz) electromagnetic field 304 radiates from a metal coil within reading device 302. When reading device 302 detects electronic key card 301, card coil 307 within card 301 detects excitation signal 306 from reading device 302. Excitation signal 306 in turn generates a small current in card coil 307. This current powers a small integrated circuit within electronic key card 301, when card 301 contains a unique identification number.

Card coil 307 within electronic key card 301 transmits this identification (ID) number using a 62.khz electromagnetic field (which is one-half the value of excitation signal 306). This 62.5 kHz electromagnetic field is an analogue RF carrier for the digital I.D. number, and is the receive signal in reading device 302. In this context, an analogue RF carrier is actually an antenna within key card 301.

Reading device 302 transmits the receive signal to RF receiver 310 within door controller 311. Door controller 311 processes, error checks and converts receive signal to a digital signal. RF receiver 310 sends the digital signal with the identification number to microprocessor 312 within door controller 311. In the preferred embodiment, door controller 311 is a SM Intelliprox model SM 1000/2000 smart module. This model is well known in the electronic industry, and can be obtained from Keri Systems Incorporated.

Figure 10:
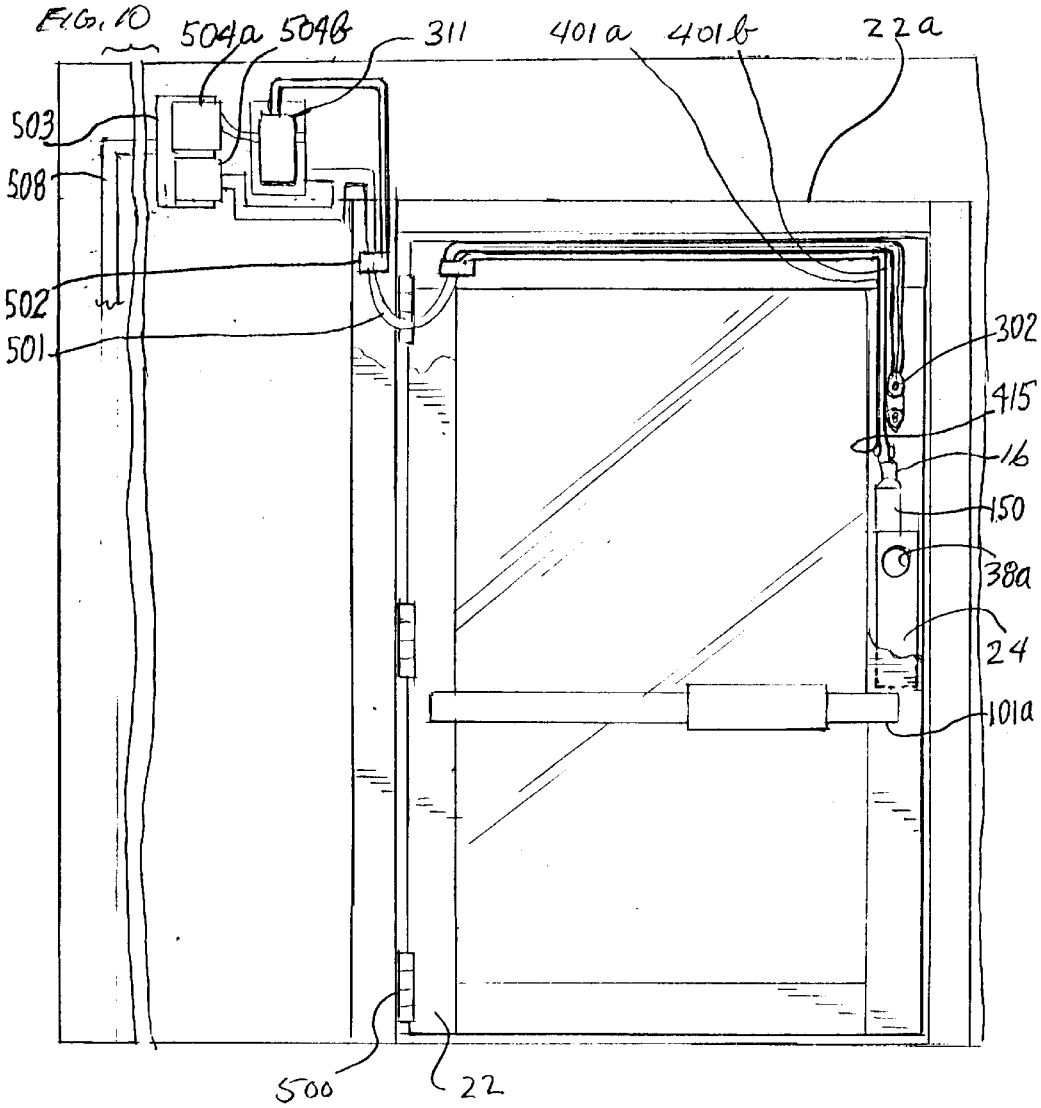
FIG. 10 is a schematic lateral view of the relative positions of the door lock and wiring scheme.

Referring now to FIG. 10, first solenoid end wire 142*a* leads to solenoid 1*a* from door controller 311. From solenoid 1*a*, second solenoid end wire 142*b* returns to the positive terminal of transformer 504*a* and then to door controller 311 to complete the circuit. The proximity access code reader 302 in the preferred embodiment can be obtained from:

Keri Systems, Incorporated
1530 Old Oakland Road
Suite 100
San Jose, Calif. 95112
Phone: 1-800-260-5265
Model #: IP 3000 Microstar Proximity Reader Door controller 311 allows access by switching the appropriate electrical relays to send low voltage current to solenoid 1*a*. This low voltage to solenoid 1*a* results in a magnetic force field, which elevates cam retaining locking bar 118*b* with attached hollow stem 118*a* away from rotating cam 56. The user can mount proximity code access reader 302 within hollow metal doorframe casing 22 (preferred), an adjacent hollow metal doorframe casing, or an edge doorframe casing.

When the appropriate voltage (12VAC, 16VAC, 24 VAC, or 12 VDC, 16 VDC,24 VDC) (where VAC indicates voltage, alternating current, and VDC indicates voltage, direct current)is applied to solenoid 1*a*, a magnetic field is created. However, the preferred solenoid voltage in my invention is approximately 16 VAC. After the appropriate time interval dictated by proximity access code reader 302, the voltage to solenoid 1*a* is discontinued. A subsequent magnetic force field of solenoid 1*a* then initiates another door access cycle by elevating hollow stem 118*a* into solenoid cavity 1*c*, until the voltage is again discontinued.

Installation Process

Prior to installation of my modified lock, the operator must determine what is known as the backset of the predetermined doorframe casing 22 with which he is working. Each hollow metal doorframe casing 22 comprises one of the following backsets: 31/32 inch; 7/8 inch; and 1 and 1/2 inch.

In this context, a 'backset' refers to the distance from edge 30*aa* or 30*bb* of lateral longitudinal plate 30 to the center of cylinder lock 66 when inserted through anterior plate 24. Each hollow metal doorframe casing 22 is precut for one particular backset. As a result, each backset distance is different, thus predetermining the exact dimensions of cam retaining locking bar 118*b*. Hollow metal doorframe casing 22 is also pre-cut, with two one and 1/4 inch apertures 38*a*,38*b*. Cylinder lock 66 and thumbturn 43 insert into these apertures respectively, after reinstallation of deadbolt 10, infra.

Proper identification of the existing lock type is also important for a proper fit within anterior, posterior and lateral longitudinal plates 24, 26, 30 respectively. In addition, the operator determines door orientation, i.e., left handed or right handed. Determination of the left or right handed orientation of hollow metal doorframe casing 22 assures that the appropriate cylinder lock 66 for only an authorized key 152 has first rotating cam 56 attached to extended shaft 35.

Figure 10A:
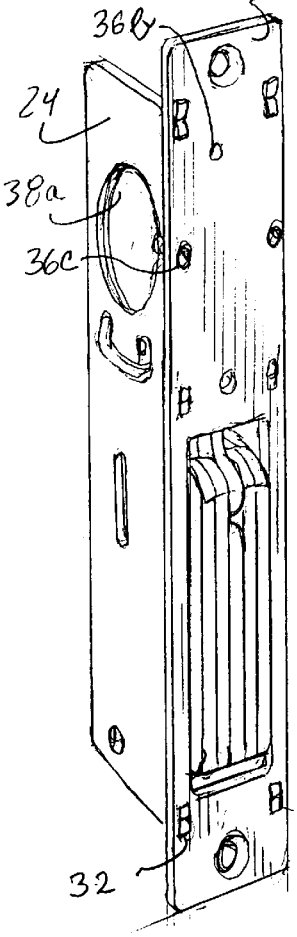
FIG. 10*a* is a partial anterior view of an anterior plate in a right handed orientation.
Figure 10B:
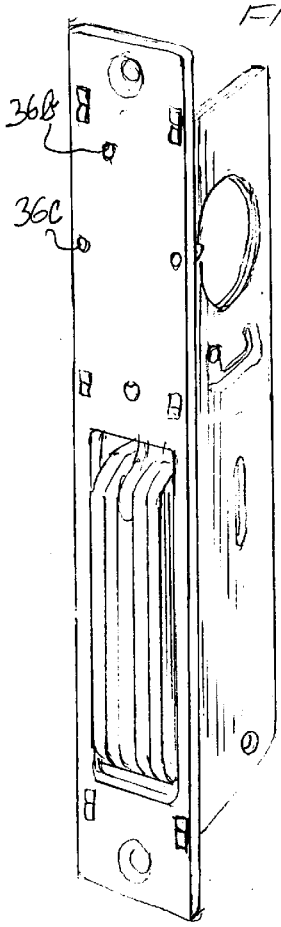
FIG. 10*b* is a partial perspective isolated view of the anterior plate in a left-handed orientation.

A right handed doorframe will have the lock on the right side of the door, when the operator is facing the doorframe casing's exterior surface. As seen in FIGS. 10*a* and 10*b*, in a left handed doorswing, there is approximately 1/8 inch offset towards large circular aperture 38*a* to the left.

In a right handed door swing, there is approximately 1/8 inch offset to the right towards large exterior circular aperture 38*a*. Similarly, a lefthanded doorframe casing has the keyed lock on the left side of the exterior surface of the door, and the hinges on the right edge of the doorframe casing. Thumbturn 43 is unrestricted because there are no conventional key access pins or electronic access features. This lack of pins and electronic access is a requirement for fire and other safety ordinances in building codes.

Whether a door is right handed or left-handed is an initial determination well known to those in this particular industry. The modification of the width of cam retaining locking bar 118*b* (as well as that of solenoid 1*a*) does not affect the installation of my electromagnetic locking device with the following backsets: 31/32 inch; 7/8 inch; one and 1/8 inch; and one and 1/6 inch. Presently, a 1 and 1/8 inch backset is the most marketed measurement in this particular industry.

Opposite edge 118*d* of cam retaining locking bar 118*b* is precut or custom adjusted for each individual hollow doorframe casing's particular backset. The increased length of opposite edge 118*d* allows cam retaining locking bar 118*b* to fit within lateral longitudinal plate 30 and posterior solenoid housing opposing wall 150*c*.

These two rigid vertical surfaces physically restrict cam retaining locking bar 118*b* from lateral movement. Lateral longitudinal plate 30 and opposing wall 150*c* also discourages attempts to force or jam cam retaining locking bar 118*b*. As seen in FIG. 10, door lock components are positioned above a typical prior art door handle 101*a*.

In the best mode and preferred embodiment of my invention, the installation of solenoid 1*a*, solenoid casing 1*b*, solenoid housing 1*c*, and cam retaining locking bar 118*b* is as follows:

Removal of Deadbolt

The operator first loosens three trimplate screws (not seen) from the attached trimplate (not seen) in the preferred embodiment. He then loosens set screws 36*c* which retain cylinder lock 66 (and/or thumbturn 43) within plates 24 or 26. He continues to loosen set screws 36*c* until cylinder lock 66 and thumbturn 43 are sufficiently loose to unthread and remove.

Figure 11:
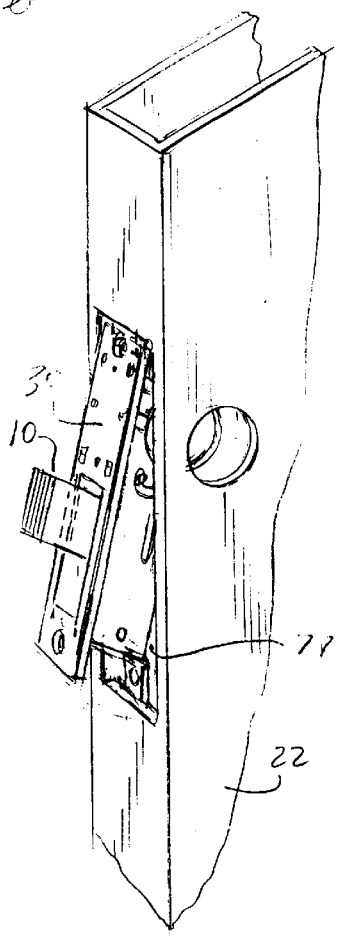
FIG. 11 illustrates how mechanical lock components are initially removed from a hollow metal doorframe casing.

After cylinder lock 66 and thumbscrew 43 are removed, the operator removes top screw 36*e* and bottom screw 36*f* which attach deadbolt within hollow metal doorframe casing 22. After removal from doorframe casing 22 (FIG. 11), deadbolt 10, along with other mechanical components between attached plates 24,26,30, are placed in an upright position within a vise.

The vise clamps lateral longitudinal plate 30, as well as anterior plate 24 and posterior plate 26. If the hollow metal doorframe casing 22 has no pre-welded mounting tabs 430*a*,430*b* (FIG. 2*c*) attachable mounting tabs for glass/aluminum doors are available as:

Adams Rite® mounting Bridge

Model No. 4104-01,-02,-03,-04 and Afco No. AF11.

In these instances, the operator uses shorter screws to fasten tabs 430,430*a*, so that the shorter screws 36*a* do not interfere with electronics and metal solenoid housing 150.

Wiring and Installation of Electronic Related Components

Deadbolt 10, rocking lever 14 and other mechanical components are now removed from and exterior to metal hollow doorframe casing 22. However, they remain within attached anterior plate 24, posterior late 26 and lateral longitudinal plate 30 and within vise 77.

The operator now turns his attention to wiring of metal hollow doorframe casing 22 and placement of electronic equipment, such as the access code proximity reader 302 and door controller 311. Access code proximity reader 302 (Keri Smart module SM 1000/2000) is preferably contained within an electronic utility box 503. Electrical utility box 503 is approximately seven inches in length, eight inches in width and four inches in depth.

As seen in FIG. 10, electric utility box 503 is preferably mounted within an inner wall surface, above a drop ceiling and near the door area. If there is no drop ceiling, then a secured room or a nearby closet are satisfactory alternatives. A pair of long 22 gauge connecting wires 401*a*,401*b* from electronic utility box 503 pass through doorcord 501 and then pass across upper doorframe casing surface 22*a*. Doorcords 501 for the preferred embodiment are available from:

Keedex Inc.

Armoured Door Loops

112931 Shackelfor Lane

Garden Grove, Calif. 92841-5108

Phone: 1-714-636-5657

Model K-DL38A24 (aluminum)

Model K-DL38B224 (durandic)

Figure 14A:
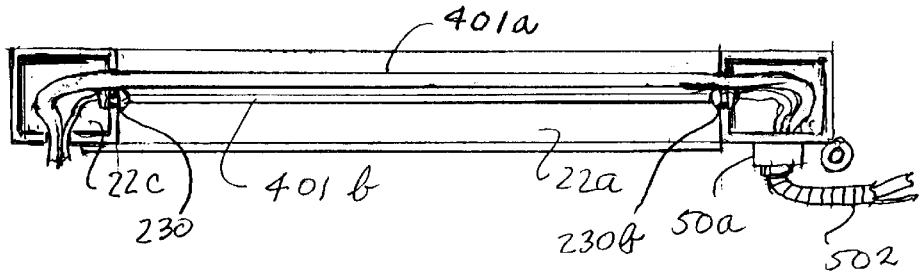
FIG. 14*a* is a top plan schematic representation of how wires pass over and then enter hollow metal doorframe casing.

Using a Dremel® wheel (model number 395,426) the operator next excises a first 'v'-cut 230*a* and second v-cut 230*b* through uppermost door casing surface 22*a*, as seen in FIG. 14*a*. The operator inserts each long connecting 22 gauge wires 401*a*, 401*b* respectively through first v-cut 230*a* and second v-cut 230*b* respectively. First and second long 22 gauge connecting wires 401*a*,401*b* respectively enter hollow interior 22*c* of hollow metal doorframe casing 22. Duct tape is recommended to assist in pulling wires 401*a*,401*b* through hollow metal doorframe casing interior 22*d*.

The length of each first and second long connecting 22 gauge wires 401*a*, 401*b* should be a minimum of approximately seven feet, to allow sufficient wire length to thread through the door frame interior. The operator can determine the approximately additional length of wires 401*a* and 401*b* by measuring the distance between door cord 501 location to the location of transformer 504*a*,504*b*. First and second solenoid wire ends 142*a*, 142*b* respectively should each be approximately six to ten inches in length. These two lengths are the minimum necessary to (i) physically and electrically connect solenoid 1*a* wire end segments 142*a*, 142*b* to 22 gauge long connecting wires 401*a* and 401*b*, while (ii) deadbolt 10 within attached plates 24,26,30 remains exterior to doorframe casing 22.

Long connecting 22 gauge wires 401*a*, 401*b* pass through door cord 501 and electrically connect to transformer 504*b* in a manner well known in this particular industry. Please see FIGS. 10, 14*a* and 14*b*. The operator next attaches the preferred B or Beanie connectors 415, with black electric tape placed over B connectors 415. B or Beanie connectors 415 crimp first and second solenoid wire ends 142*a*, 142*b* respectively to each first and second ends 401*c*, 401*d* respectively, of long connecting 22 gauge wires 401*a*, 401*b* respectively.

The wiring process, installation, and electrical connection of transformers 504*a*,504*b*, access code proximity reader 302, and door controller 311 to solenoid 1*a*, is completed in a manner well known in this particular industry. In sum, long connecting 22 gauge wires 401*a*,401*b*, as well as proximity reader 302 six (6) conductor shielded wire 404*a*, run from door controller 311 through the walls to and through door cord 501. All three wires 401*a*,401*b*, 404*a* pass through door cord 501 over upper hollow metal doorframe casing surface 22*a*.

Figure 14B:
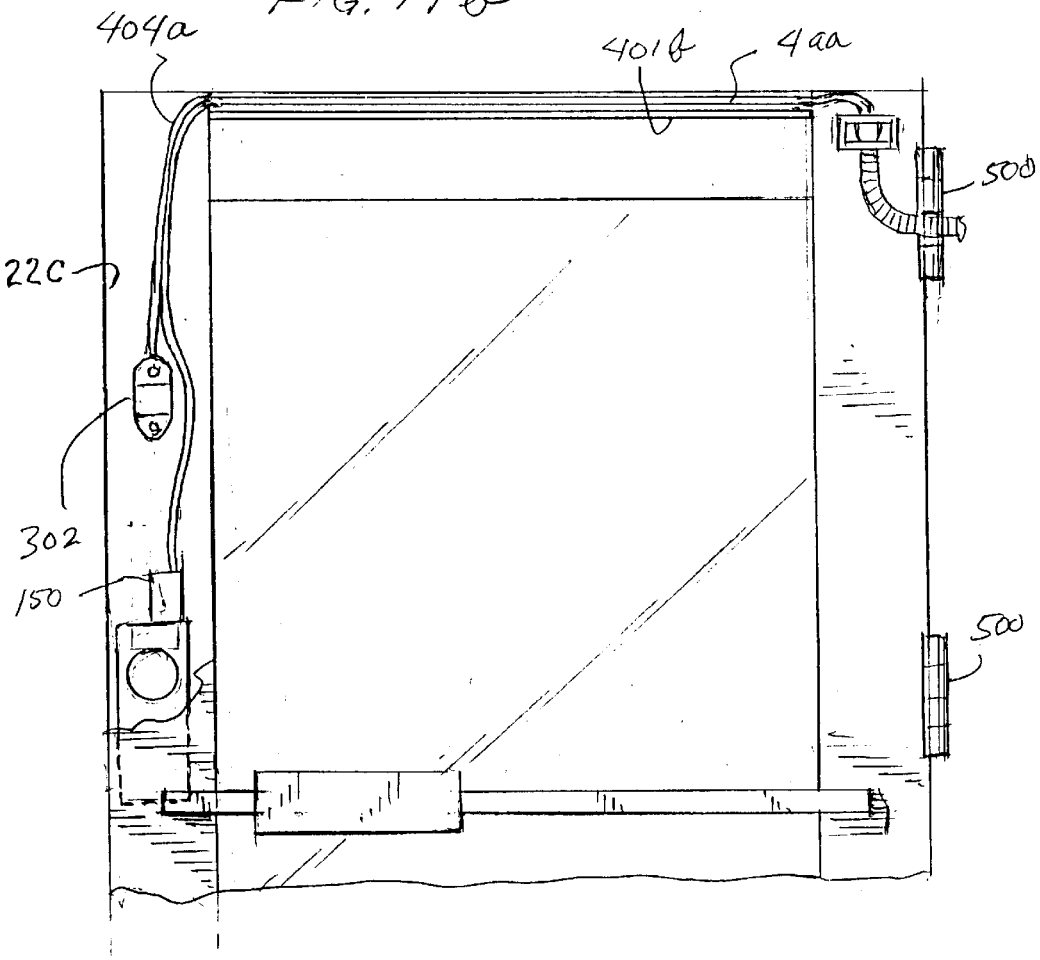
FIG. 14*b* is an anterior view of the interior hollow metal doorframe casing illustrating exposed wiring and electronic components.
Figure 15:
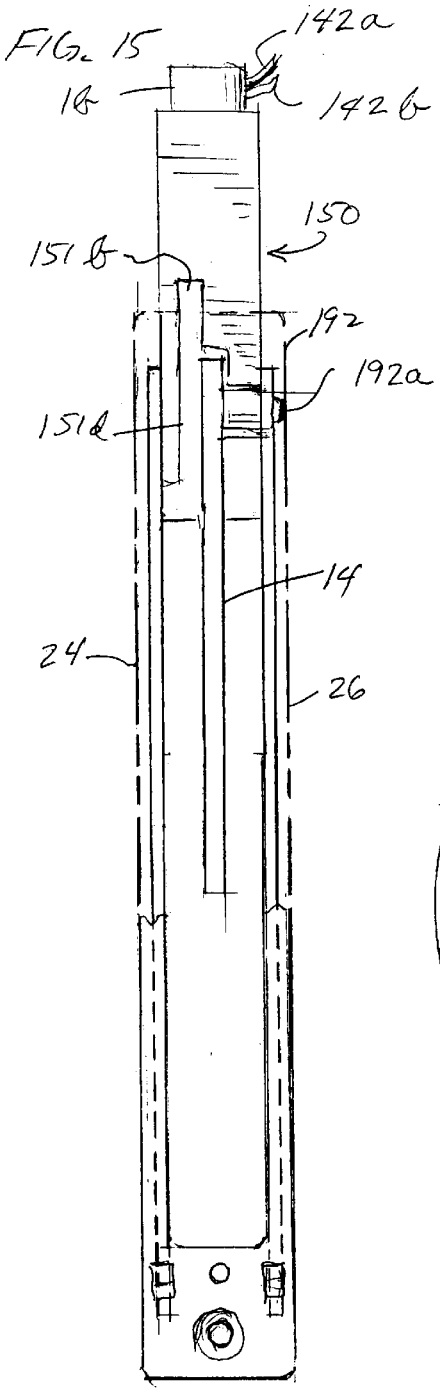
FIG. 15 illustrates the alignment of metal solenoid housing during the installation process.

Wire 404*a* electrically and physically connects to proximity reader 311 (not shown in FIG. 14*b*). All three wires 401*a*,401*b*,404*a* then enter hollow interior of hollow metal doorframe casing 22 through v-cuts 230*a*,230*b*, in a contiguous manner well known in this particular industry.

Insertion of Solenoid 1*a* and Other Components Into Hollow Metal Doorframe Casing 22

Figure 12:
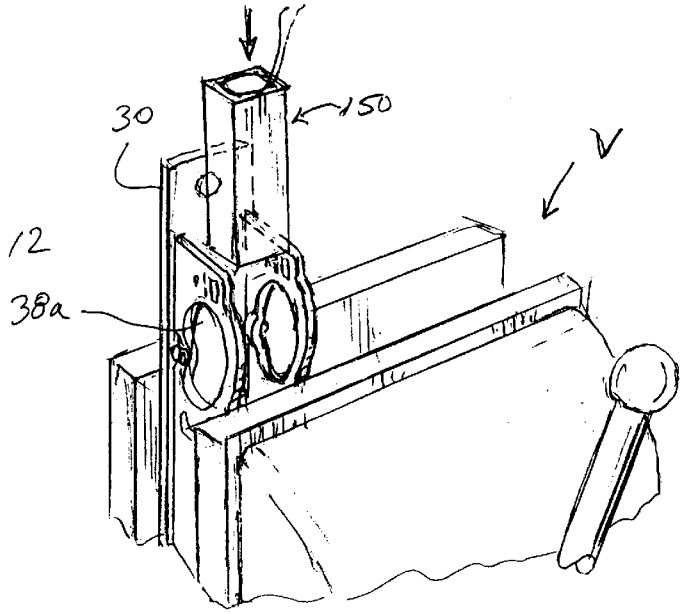
FIG. 12 illustrates how the attached plates are oriented within a vise after removal from a hollow metal doorframe casing.

Solenoid 1*a*, although now electrically connected through doorframe casing 22 by aperture 77, remains exterior to hollow metal doorframe casing 22 at this point in the installation process. Anterior plate 24, posterior plate 26 and lateral longitudinal plate 30 remain attached to each other, and within a vise as shown in FIG. 12.

Turning now to the subassembly of the new components, in some embodiments the operator inserts solenoid 1*a* into cylindrical solenoid casing 1*b*. In the preferred embodiment, as described supra, solenoid 1*a* comes presealed on a hollow spool 1*e* within solenoid cylindrical casing 1*b*.

The operator next takes cam retaining locking bar 118*b* and attaches it to metal hollow stem 118*a* by insertion of small knob 118*a* into ovoid slot 118*g*. The operator also inserts small spring 123 into metal hollow stem 118*a*. The operator slides assembled cam locking retaining bar 118*b* and hollow stem 118*a*, into cylindrical casing cavity 1*c*. The operator aligns cam-retaining locking bar 118*b* and cylindrical solenoid casing 1*b* within a predetermined metal solenoid housing 150.

The operator now inserts a Dremel® wheel through large circular aperture 38*a*. He severs sleeve 192 and large pin 192*a* immediately adjacent to rocking lever 14, and on the surface 14*e*,14*f* which will abut cam retaining locking bar 118*b*. Whether the operator severs on first longitudinal surface lever 14*e* or second longitudinal lever surface 14*f* depends upon whether hollow metal doorframe casing 22 is right-handed or lefthanded. As noted supra, this is predetermined in a manner well known in this particular industry. Please see FIG. 12.

Alternatively and in other modes, the operator can obtain precut mechanical lock components which are pre-cut for a right handed or left-handed installation. Generally, first longitudinal lever surface 14*e* requires large sleeve 192 and large pin 192*a* severed for a right-handed installation. Second longitudinal lever surface 14*f* requires sleeve 192 and pin 192*a* to be severed for a left handed doorframe installation.

Using a hand drill or drill press with a ¼ inch drill bit, the operator now removes that portion of large pin 192*a* which remains attached to anterior plate 24. The operator also sands first longitudinal lever surface 14*e* or second longitudinal lever surface 14*f* until either surface is smooth and flat (depending again upon whether the handle assembly is right handed or left handed).

The distance between anterior plate interior surface 24*b* and posterior plate interior surface 26*b* is slightly more than ⅝ of an inch. Similarly, the width and depth of metal solenoid housing 150 are both slightly less than ⅝ inch. This means that after large sleeve 192 and large pin 192*a* are removed, the operator can push metal solenoid housing downward so that mechanical fasteners attach metal solenoid housing 150 to anterior and posterior plates 24,26 respectively.

After large sleeve 192 and large pin 192 are severed and removed, the operator manually positions metal solenoid housing 150 vertically downward between anterior plate 24 and posterior plate 26. At this point, metal solenoid housing 150 is adjusted to its final position. Small rivet tapped apertures of approximately ⅛ inch diameter 163*a*, 163*b*, 164*a*, 164*b* are drilled through metal solenoid housing walls 150*a*, 150*b*, 150*c*, 150*d*. Rivets 167 which are approximately ⅛ thick by ¼ inch long, or other similar small mechanical fasteners are fastened and secured into apertures 163*a*, 163*b*, 164*a*, 164*b*, and mechanically attach metal solenoid housing 150 to anterior plate 24.

The operator now cuts cam retaining locking bar 118 to fit for either a right handed or left handed installation within the preferred backset of 1 and ⅛ inch. After this adjustment, cam retaining locking bar 118*b* now fits into space created by cutting and sanding away large pin 192*a* and large sleeve 192. The preferred appropriate Dremel® wheel for adjusting the length of cam retaining locking bar 118*b* is model number #3950. This Dremel® wheel is available from:

Dremel® Accessories
P.O. Box 081126
Racine, WI. 53408-1126
Phone: 414-554-1390

After metal solenoid housing 150 is positioned between anterior plate 24 and posterior plate 26, the operator adjusts solenoid housing's lower edge 151*e*. Such adjustment is made with a hand held frictional wheel, drill, shears, or other appropriate tool well known in the locksmithing industry. As seen in FIG. 10*b*, temporary assisting screw 36*b* supports cam retaining locking bar 118*b* during installation. This same temporary assisting screw 36*b* is then loosened until cam retaining locking bar 118*b* drops over rotating cam 56. The operator removes temporary assisting screw immediately thereafter. Cylinder lock 66 is then threaded into large circular aperture 38*a* for testing the operation of the newly installed components.

This is the last step occurring within the vise, and prior to checking function and connecting wire segments 142*a* and 142*b* to long connecting 22 gauge wires 401*a* and 401*b*. In this manner, lower edge 151*e* sufficiently clears rocking lever 14 when solenoid housing 150 is properly aligned within anterior plate 24, lateral longitudinal plate 30 and posterior plate 26. Metal solenoid housing 150 must also allow rocking lever 14 to pivot when deadbolt 10 rotates from a default locked position to an open unlocked position.

The operator now inserts cylindrical solenoid casing 1*b* into metal solenoid housing 150. Casing 1*b* extends as far downwardly as possible without jamming cam retaining locking bar 118*b*.

The operator drills approximately 7⁄64 inch diameter apertures into metal solenoid housing 150. Please see FIG. 5*a*. These apertures are best drilled with a "pling" style tap and inserted with machine screws 36*m*.

Machine screws 36*m* retain and stabilize solenoid 1*a* within metal solenoid housing 150 until solenoid 1*a* requires replacement. Metal solenoid housing 150, cylindrical solenoid casing 1*b*, solenoid 1*a*, and cam retaining locking bar 118*b* with attached hollow stem 118*a* are now assembled above rocking lever 14. Deadbolt 10 remains attached to and interior to plates 24, 26, 30, while the entire assembly remains exterior to metal hollow doorframe casing 22.

Referring now to FIGS. 13*a* and 13*b*, the next step is the physical installation of the mechanical and electronic lock components within attached plates 24,26,30 into hollow metal doorframe casing 22. The operator tips attached anterior, posterior and lateral longitudinal plates 24, 26, 30 respectively through large rectangular aperture 77 past mounting tabs 430*a*, 430*b*. He finally reinserts them upwardly into hollow metal doorframe casing 22.

Plates 24,26,30 are now upright and flush within hollow metal doorframe casing 22. Lateral longitudinal plate 30 is also properly aligned with upper tab aperture 430*a*.

The operator places small screws 36*a* (approximately 10⁄32 inch diameter×⅜ inch long)through top aperture 30*a* and bottom aperture 30*b*, and into hollow metal doorframe casing 22. He then tightens deadbolt 10 into hollow metal doorframe casing 22.

The operator next reinserts cylinder lock 66 into aperture 38*a* and thumbturn 43 into circular aperture 38*b*, and then tightens set screws 36*c*. He next checks for proper rotation of extendable shaft 35 by locking and unlocking now re-installed deadbolt 10 with key 152. After lock cylinder 66 and thumbturn 43 are re-installed, the operator loosens temporary assisting screw 36*b*, allowing cam retaining locking bar 118*a* to grip rotating cam 56.

Alternatively, an operator skilled in the art of locksmithing can partially prepare a hollow metal doorframe casing 22 with components of a kit. In the best mode and preferred embodiment, each kit contains the following: preassembled solenoid 1*a* within cylindrical casing from Adams-Rite, solenoid housing 150, hollow member 118*a*, small spring 123 and cam retaining locking bar 118*b*. Electronic reader and processors 302,307 as well as electronic key cards 301 and related equipment could also be included within each kit and remain within the scope of my invention.

In the preferred embodiment and best mode, each kit is intended for one doorframe per service call per operator. However, kits with varying numbers of installation components, or kinds of components are also within the scope of my invention. For example, some kits would only include a cam retaining locking bar 118*b*, hollow stem 118*a*, third spring 123, pre-assembled solenoid 1*a* from Adams-Rite® and solenoid housing 150.

If a kit comprises the preassembled solenoid 1*a*, metal solenoid housing 150, hollow stem 118*a*, third spring 123, and cam retaining locking bar 118*b*, a person skilled in this particular art would require approximately one hour to install these new components as a retrofit. In this context, "retrofit" indicate the operator's use of Adams-Rite® deadbolts 10 or hookbolts 10*a*.

These particular deadbolts and hookbolts, in turn, are compatible with Adams-Rite® glass/aluminum hollow doorframe casings 22, and are easily replaced by the operator's inventory in an emergency. The one-hour timeframe, supra, includes the reinstallation of mechanical components rocking lever 14, deadbolt 10*a*, extension pins 202*a*, 204*a*, first and second opposing roller cams 202, 204 and rotating sleeve 210, and first and second springs 1β*a*, 1β*b*. It also includes insertion and attachment of cylindrical solenoid casing 1*b* within metal solenoid housing 150, cam retaining locking bar 1*b*, hollow stem 11β*a* and their proper alignment; reinstallation of lateral longitudinal plate 30, anterior plate 24, posterior plate 26, and removal of large pin 192*a* and sleeve 192.

An additional time of approximately two to three hours is necessary required to connect my integrated lock to Keri smart module 145 (model 1000/2000) and proximity access code reader 302. Cam retaining locking bar 118*b* is the least vulnerable point for physical damage, because cam retaining locking bar 118*a* physically blocks attempts to wrench lock cylinder 66 during unauthorized entry attempts. In addition, with my invention there is no irreparable cutting or physical alteration hollow metal door frame casing 22. Instead installation of cam retaining locking bar 118*a* and solenoid 1*a* preserves the physical integrity of the previously installed door frame.

My cam retaining locking bar 118*b* greatly maximizes circumvention of cylindrical lock 66, because it physically blocks intentional rotational motion even if cylinder lock 66 is destroyed. My cam retaining locking bar 118*b* also preserves the physical integrity of extending shaft 35. This damage occurs when the unauthorized third party uses a conventional screw driver to rotate extending shaft 35 through key aperture 35*c*.

The retention of cylinder cam locking bar 118 fitting tightly around cylindrical lock shaft cam member 35*a* immediately slows and frustrate manual attempts to physically wrench the mechanical lock. Mechanical locks of the future can be upgraded for extra security with my new electromagnetic integrative security devices. The description of my preferred embodiment in no way diminishes the scope or embodiments of my invention.

I claim:

1. A method for upgrading mechanical lock components within a hollow metal doorframe casing of a door by integrating said mechanical locking components with electronic access security components, said method comprising:

(a) insertion of a magnetic field generating device between said previously assembled mechanical lock components, said insertion occurring while said magnetic field generating device is positioned exterior to said hollow metal door frame casing and, (b) electrically connecting said magnetic field generating device so it can override said mechanical lock components by activating a physically obstructing electronically controlled lock component, said physically obstructing electronically controlled lock component obstructing by vertical movement within said magnetic field generating device, said method occurring without modification to said hollow metal door frame casing, said magnetic field generating device being a solenoid, said electrically controlled lock component being a cam retaining locking bar with an attached hollow stem and interior small spring, said cam retaining locking bar with attached hollow stem and interior small spring inserted above a rocking lever after said assembled mechanical locking components are removed from said hollow metal door frame casing and placed in an upright position within a vise.

2. A method for upgrading mechanical lock components, said mechanical lock components being initially installed within a hollow metal door frame casing of a door, by integrating said mechanical lock components with electronic access security components, said method resulting in no modification to said hollow metal door frame casing, said method comprising (a) determining the backset of said hollow metal door frame casing into which a cylinder lock and thumb turn insert, (b) physically adjusting a cam retaining locking bar for each said backset, (c) removing an attached trim plate, anterior plate and posterior plates, and then removing said cylinder lock and/or said thumb turn from said door frame casing, said plates remaining attached to each other plate exterior to said door frame casing, (d) removing the dead bolt within said door-frame casing, (e) retaining said dead bolt, along with a rocking lever, rotating cam and other mechanical components, between said attached plates in an upright position within a vise, (f) mounting a transformer, proximity reader, and door controller proximal to said door frame casing, then electrically connecting said transformer, proximity reader and said door controller through said door frame casing to a solenoid, said solenoid within said solenoid casing, and said solenoid casing initially positioned exteriorly to said door frame casing, (g) aligning said assembled cam retaining locking bar and said cylindrical solenoid casing within a metal solenoid housing, said metal solenoid housing being initially positioned exterior to said door frame casing and said vise, (h) smoothing a first or second longitudinal rocking lever surface which will abut said fully assembled cam retaining locking bar, (i) manually pushing said metal solenoid housing downward within said vise, until said metal solenoid housing is positioned between said attached anterior, posterior and longitudinal plates, (j) adjusting said solenoid housing's lower edge, and then placing said cam retaining locking bar over said rotating cam within said attached plates, said attached plates still upright within said vise, (k) attaching said solenoid housing to anterior and posterior plates with rivets or small machine screws, said longitudinal plate and said posterior plate still within said vise, and (l) tipping said longitudinal plates through a large rectangular aperture past mounting tabs along said metal hollow door frame casing, (m) attaching said longitudinal plates within said hollow metal door frame casing and tightening said dead bolt into said hollow metal door frame casing, (p) reinserting said cylinder lock and said thumb turn into said hollow metal door frame casing, thereby allowing said cam retaining locking bar to grip said rotating cam within said hollow metal door frame casing.

* * * * *